US009508211B2

(12) United States Patent
Roekens et al.

(10) Patent No.: US 9,508,211 B2
(45) Date of Patent: Nov. 29, 2016

(54) MERCHANDISER

(71) Applicant: The Coca-Cola Company, Atlanta, GA (US)

(72) Inventors: Jurgen Roekens, Kampenhout (BE); Bart Carpentier, Zoersel (BE); Erik Van Genechten, Geel (BE)

(73) Assignee: The Coca-Cola Company, Atlanta, GA (US)

( * ) Notice: Subject to any disclaimer, the term of this patent is extended or adjusted under 35 U.S.C. 154(b) by 979 days.

(21) Appl. No.: 13/657,975

(22) Filed: Oct. 23, 2012

(65) Prior Publication Data

US 2013/0112702 A1 May 9, 2013

Related U.S. Application Data

(63) Continuation-in-part of application No. 13/076,631, filed on Mar. 31, 2011, now Pat. No. 8,518,351, and a continuation-in-part of application No. 12/828,345, filed on Jul. 1, 2010, now Pat. No. 8,757,434.

(51) Int. Cl.

| | |
|---|---|
| ***G07F 9/10*** | (2006.01) |
| ***A47F 3/04*** | (2006.01) |
| *F25D 25/02* | (2006.01) |

(52) U.S. Cl.

CPC ..... *G07F 9/105* (2013.01); *A47F 3/0486* (2013.01); *F25D 25/027* (2013.01)

(58) Field of Classification Search

CPC ..... F25D 25/027; A47F 3/0486
USPC ..... 221/66, 262, 167, 234, 236, 264
See application file for complete search history.

(56) References Cited

U.S. PATENT DOCUMENTS

| | | | | |
|---|---|---|---|---|
| 882,858 | A * | 3/1908 | Alexander et al. | G07F 11/52 194/250 |
| 2,254,208 | A | 9/1941 | Buford | |
| 2,260,643 | A | 10/1941 | Rosan | |
| 2,266,025 | A | 12/1941 | Grau | |
| 2,371,845 | A | 3/1945 | Robison | |
| 2,408,444 | A * | 10/1946 | Payne | F25D 25/00 221/281 |
| 2,671,001 | A | 3/1954 | Ossanna, Jr. | |
| 3,055,548 | A | 9/1962 | Allegri | |
| 3,294,282 | A | 12/1966 | Brown | |
| 4,252,250 | A | 2/1981 | Toth | |
| 4,325,227 | A | 4/1982 | Ibrahim | |
| 4,361,012 | A | 11/1982 | Ibrahim | |
| 4,411,351 | A | 10/1983 | Lowder et al. | |
| 4,478,047 | A | 10/1984 | Ibrahim | |

(Continued)

FOREIGN PATENT DOCUMENTS

| | | |
|---|---|---|
| FR | 2626757 A1 | 1/1989 |
| FR | 2641887 A1 | 7/1990 |

(Continued)

OTHER PUBLICATIONS

U.S. Appl. No. 29/423,505, filed Jun. 1, 2012, Roekens, et al.

*Primary Examiner* — Michael K Collins

(57) ABSTRACT

The present application provides a merchandiser for dispensing a number of products. The merchandiser may include an a temperature controlled compartment with a number of concentric storage wheels for storing the number of products therein, an input system positioned about the temperature controlled compartment, and a vending system positioned about the temperature controlled compartment.

7 Claims, 22 Drawing Sheets

(56) References Cited

U.S. PATENT DOCUMENTS

| | | | | |
|---|---|---|---|---|
| 4,615,169 | A | 10/1986 | Wurmli | |
| 4,687,119 | A | 8/1987 | Juillet | |
| 4,823,982 | A | 4/1989 | Aten et al. | |
| 4,919,250 | A | 4/1990 | Olson et al. | |
| 5,048,719 | A | 9/1991 | Empl et al. | |
| 5,201,191 | A | 4/1993 | Bustos | |
| 5,247,798 | A | 9/1993 | Collard, Jr. | |
| 6,073,460 | A | 6/2000 | Credle, Jr. et al. | |
| 6,170,230 | B1 | 1/2001 | Chudy et al. | |
| 6,173,582 | B1 | 1/2001 | Hixson | |
| 6,247,610 | B1 | 6/2001 | Ziesel et al. | |
| 6,286,715 | B1 | 9/2001 | Ziesel et al. | |
| 6,499,627 | B2 | 12/2002 | Arai | |
| 6,625,952 | B1 | 9/2003 | Chudy et al. | |
| 6,801,836 | B2 | 10/2004 | Schanin | |
| 6,808,082 | B2 | 10/2004 | Ohkubo | |
| 7,228,989 | B2 | 6/2007 | Bhatti et al. | |
| 7,497,352 | B2 * | 3/2009 | Segiet | G07F 9/105 221/150 A |
| 8,757,434 | B2 * | 6/2014 | Roekens | A47F 3/0491 194/229 |
| 2003/0201275 | A1 | 10/2003 | Tamura | |
| 2004/0026446 | A1 | 2/2004 | Mori et al. | |
| 2004/0140317 | A1 | 7/2004 | Forte | |
| 2006/0028392 | A1 | 2/2006 | Coveley | |
| 2006/0261080 | A1 | 11/2006 | Matsumoto et al. | |
| 2008/0011771 | A1 | 1/2008 | Roekens et al. | |
| 2008/0245820 | A1 | 10/2008 | Pfister et al. | |
| 2009/0029016 | A1 | 1/2009 | Pfister et al. | |
| 2010/0024913 | A1 | 2/2010 | Howard | |
| 2012/0000744 | A1 * | 1/2012 | Roekens | A47F 3/0491 194/350 |
| 2012/0000927 | A1 * | 1/2012 | Carpentier | A47F 3/0491 221/1 |
| 2012/0200215 | A1 * | 8/2012 | Marzaro | A47F 3/0486 312/408 |

FOREIGN PATENT DOCUMENTS

| | | | |
|---|---|---|---|
| WO | 00/32477 | A1 | 6/2000 |
| WO | 2004/017268 | A2 | 2/2004 |
| WO | 2006/036153 | A1 | 4/2006 |
| WO | 2008057914 | A2 | 5/2008 |
| WO | 2010/008611 | A2 | 1/2010 |
| WO | 2010149402 | A1 | 12/2010 |
| WO | 2012/003206 | A2 | 1/2012 |

* cited by examiner

MERCHANDISER

RELATED APPLICATIONS

The present application is a continuation-in-part of U.S. Ser. No. 13/076,531, entitled "Merchandiser", filed on Mar. 31, 2011, which, in turn, is a continuation-in-part of U.S. Ser. No. 12/828,345, entitled "Merchandiser", filed on Jul. 1, 2010. U.S. Ser. Nos. 13/076,531 and 12/828,345 are incorporated herein by reference in full.

TECHNICAL FIELD

The present application and the resultant patent relate generally to merchandisers such as coolers and other types of product dispensers and more particularly relate to a merchandiser with features of an open front cooler and with the increased energy efficiency of a glass door merchandiser.

BACKGROUND OF THE INVENTION

Generally described, an open front cooler includes a refrigerated open enclosure with a number of products therein within the reach of a consumer. Because of this quick and easy accessibility and proximity to the chilled products therein, open front coolers often spur impulse purchases by consumers who prefer chilled products to those at ambient temperatures. As a result, open front coolers generally provide an increased sales volume over conventional glass door merchandisers and the like of the same size and/or in similar locations and/or with products stored at ambient temperatures on shelves.

One drawback with conventional open front coolers, however, is that the cooler consumes several times more energy than a glass door merchandiser of the same size due to the lack of a door or other type of insulated front space. The increased sales revenue generally provided by an open front cooler thus may not cover or justify the increased energy cost.

There is thus a desire therefore for an improved open front cooler or other type of merchandiser that promotes impulse purchases and easy accessibility such as in an open front cooler but with the reduced energy costs of a glass door merchandiser and the like.

SUMMARY OF THE INVENTION

The present application and the resultant patent thus provide a merchandiser for dispensing a number of products. The merchandiser may include an a temperature controlled compartment with a number of concentric storage wheels for storing the number of products therein, an input system positioned about the temperature controlled compartment, and a vending system positioned about the temperature controlled compartment.

The present application and the resultant patent further provide a merchandiser for dispensing a number of products. The merchandiser may include a storage wheel, an input canister positioned about the storage wheel, a delivery canister and a reject column positioned about the input canister, an identification module positioned about the input canister such that the input canister rotates towards the delivery canister or the reject column, and an input pusher system positioned about the delivery canister and the storage wheel.

The present application and the resultant patent further provide a method of dispensing one of a number of temperature controlled products. The method may include the steps of receiving an ambient product, rotating the ambient product to identify the ambient product, accepting the ambient product if it is identified or rejecting the ambient product if it is not, pushing the temperature controlled product out of a cup on a storage wheel if the ambient product is accepted, rotating the storage wheel, and pushing the ambient product into the cup of the storage wheel.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
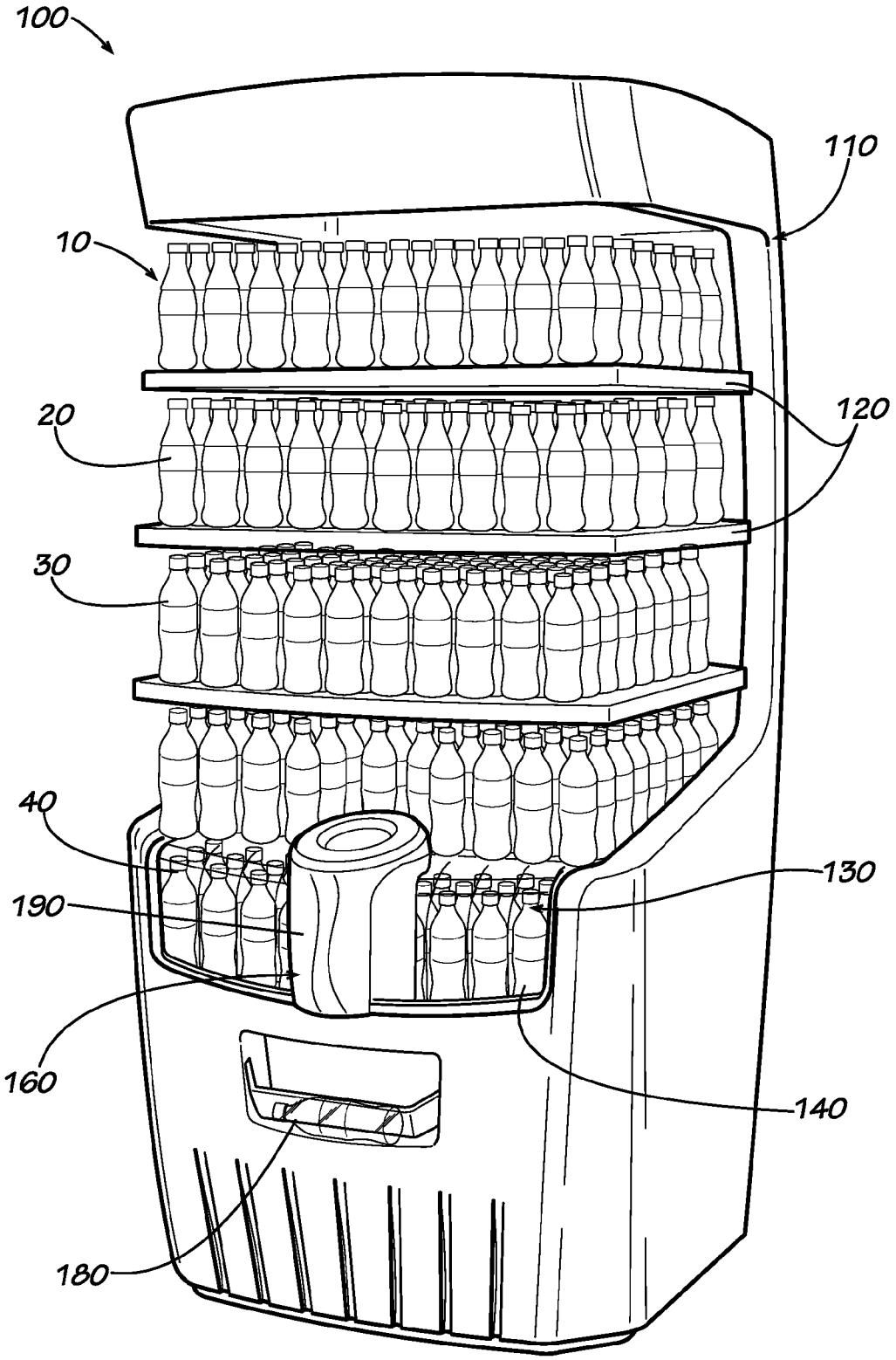
FIG. 1 is a perspective view of an example of a merchandiser as is described herein.

The present application concerns the offer for sale or other use of any number of products 10. Although the products 10 are shown, by way of example only, in the form of bottles 20, is understood that the products 10 may include any type or size of container including, but not limited to, bottles, cans, pouches, boxes, wrapped items, and/or any type of rigid or flexible packaging. The products 10 may include beverages, food items, non-food items, consumer products, and/or any type of product 10 that may be positioned on a shelf and/or that may be vended. The scope of this application is in no way limited by the nature of the products 10 intended to be used herein. Similarly, while one use herein is for a chilled product 10, it will be understood that the products 10 herein may be at ambient, refrigerated, frozen, heated, or at any desired temperature or state.

As will be described in more detail below, the products 10 herein may take the form of ambient products 30 and temperature controlled products 40. The ambient products 30 and the temperature controlled products 40 may or may not be the same products 10. Other product variations may be used herein.

Figure 2:
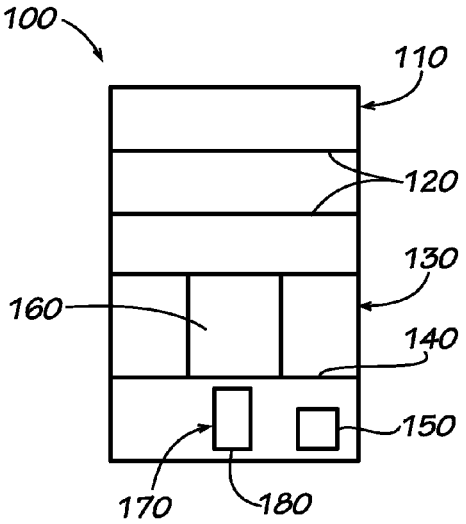
FIG. 2 is schematic view of the merchandiser of FIG. 1.

FIGS. 1 and 2 show a merchandiser 100 as may be described herein. The merchandiser 100 may include one or more open or ambient compartments 110. Each ambient compartment 110 may include a number of open or ambient compartment shelves 120. Any number of ambient compartment shelves 120 may be used. Likewise, the ambient compartment shelves 120 may have any desired shape or size. Any number of the products 10 may be placed on the ambient compartment shelves 120. Although flat shelves are shown herein, the ambient compartment shelves 120 may be any structure that may support the products 10 such as angled shelves, gravity feed shelves, neck tracker tubes, product chutes, and the like. Likewise, vertical columns and conventional vending columns also may be used. At least the front of the ambient compartment 110 may allow substantially unimpeded access to the products 10 on the ambient compartment shelves 120.

The ambient compartment 110 described herein generally at an ambient temperature and as such is not temperature controlled. Likewise, the products 10 therein may be at an ambient temperature. Part or the entire ambient compartment 110, however, could be heated, cooled, or otherwise temperature controlled as desired at least temporarily.

The merchandiser 100 also may include a temperature controlled compartment 130. The temperature controlled compartment 130 may be enclosed and/or insulated. The temperature controlled compartment 130 may have any number of temperature controlled shelves 140 or other types of support structures. The temperature controlled shelves 140 may have any desired shape, size, or orientation. Although only one temperature controlled shelf 140 is shown, any number of shelves 140 may be used. Although flat shelves are shown herein, the temperature controlled shelves 140 may be any structure that may support the products 10 such as angled shelves, gravity feed shelves, neck tracker tubes, product chutes, and the like. Likewise, vertical columns and conventional vending columns also may be used. Although the temperature controlled compartment 130 is shown in FIGS. 1 and 2 as integral with the merchandiser 100, it is to be understood that the temperature controlled compartment 130 may operate as a stand-alone unit, allowing ambient products 10 such as on traditional store shelves or containers to be used in combination with the temperature controlled compartment 130 as described herein.

The number of ambient compartment shelves 120 is generally greater than the number of temperature controlled shelves 140, but not necessarily so. The temperature controlled compartment 130 may be at any desired temperature from freezing, chilled, ambient, warm, or hot. The temperature controlled compartment 130 may be in communication with a conventional heating/cooling module 150 and the like. Multiple temperature controlled compartments 130 with multiple temperatures also may be used herein. Although the temperature controlled compartment 130 is shown as positioned beneath the ambient compartment 110, the temperature controlled compartment 130 may be positioned on top, on the side, or, as explained below, apart from the ambient compartment 110.

The temperature controlled compartment 130 and/or the ambient compartment 110 may include a scanner or other type of identification module 160. The identification module 160 may include a barcode scanner, an RFID tag reader, photoelectric cells, and/or any type of device that may read indicia on the product 10, identify the shape of the product 10, or otherwise identify the product 10. Alternatively, the identity of the product 10 may be entered or otherwise indicated by a consumer such as by pressing a product selection button and the like. Other types of selection means may be used herein. Although the identification module 160 is shown as being positioned adjacent to the temperature controlled compartment 130, the identification module 160 may be positioned in any convenient location. The identification module 160 also may reject a product 10 that is not intended to be used with the merchandiser 100 as a whole.

The merchandiser 100 also may include a vending module 170. The vending module 170 may include a vending port 180. Although the vending port 180 is shown as being positioned adjacent to the temperature controlled compartment 130 and the identification module 160, the vending module 170 may be positioned in any convenient location.

The vending module 170 may include an internal transport system 190. The internal transport system 190 may transport the products 10 from the identification module 160 or other location to a location within the temperature controlled compartment 130 or otherwise. The internal transport system 190 also may transport the products 10 to the vending port 180 or otherwise as desired. Any number of internal transport system configurations may be used herein.

Figure 3:
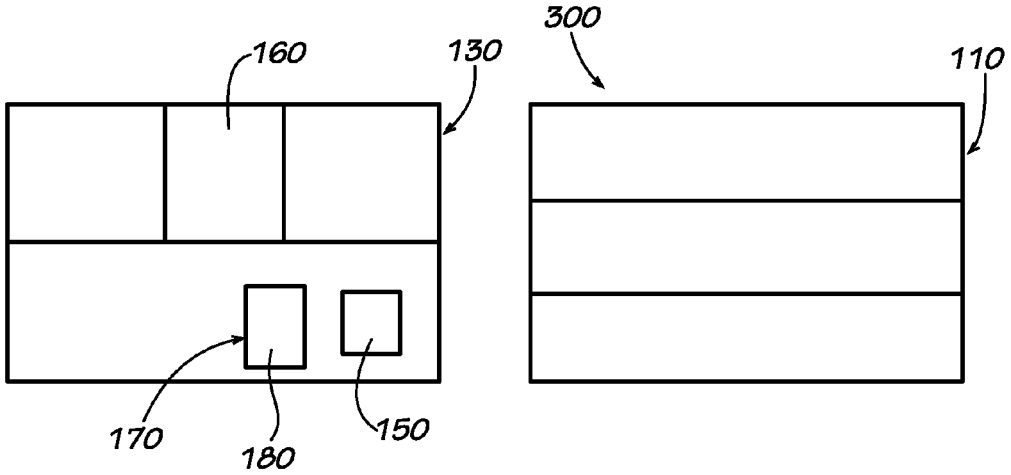
FIG. 3 is a schematic view of an alternative embodiment of a merchandiser as may be described herein.
Figure 4:
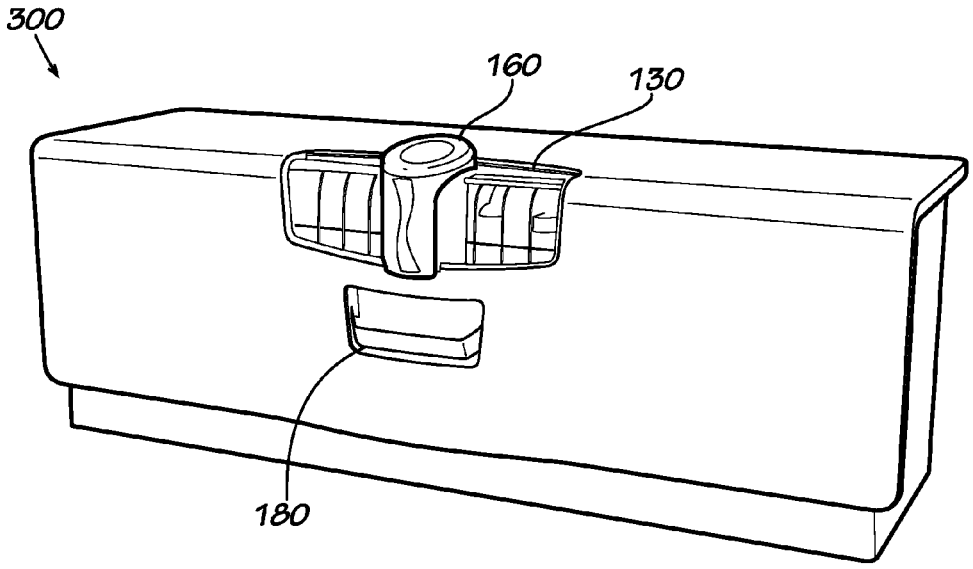
FIG. 4 is a perspective view of an example of the merchandiser of FIG. 3.

FIGS. 3 and 4 show a further embodiment of a merchandiser 300. In this embodiment, the merchandise 300 may be modular with the ambient compartment 110 separate from the temperature controlled compartment 130. Although the identification module 160 is shown as being part of the temperature controlled compartment 130, the identification module 160 also may be positioned at any convenient location. Likewise, the heating/cooling module 150 is shown as being positioned within the temperature control compartment 130 but also could be positioned elsewhere as may be desired. Moreover, only the temperature controlled compartment 130 may be used. Other configurations may be used herein.

Figure 5:
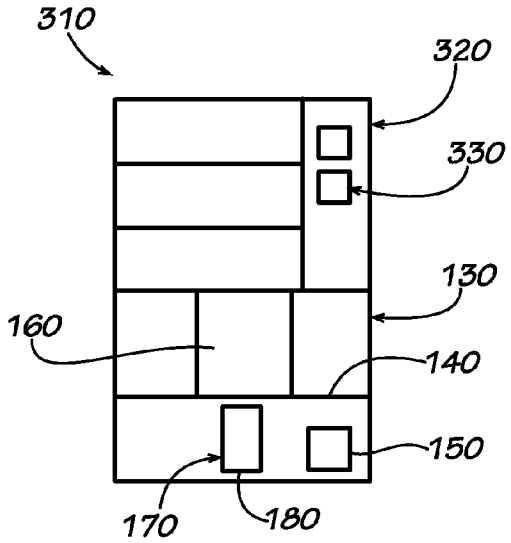
FIG. 5 is a schematic view of a further alternative embodiment of a merchandiser as may be described herein.
Figure 6:
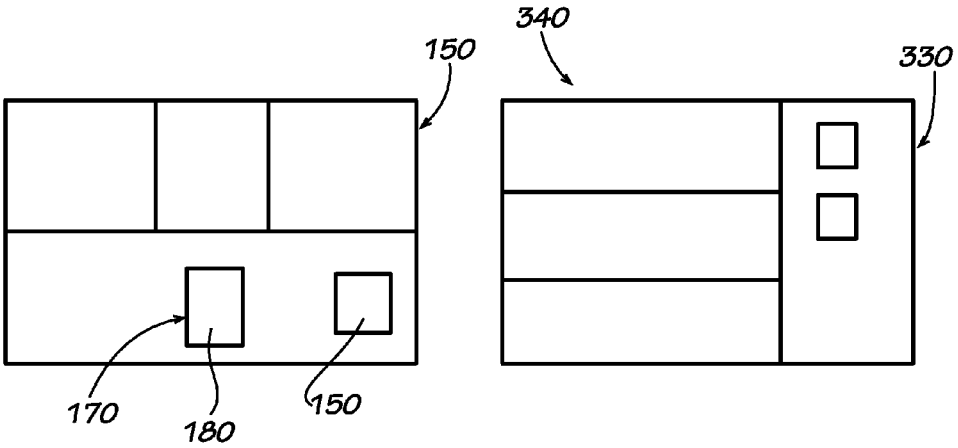
FIG. 6 is a schematic view of a further alternative embodiment of a merchandiser as may be described herein.

FIG. 5 shows a further embodiment of a merchandiser 310. The merchandiser 310 may include a vending compartment 320 instead of the ambient compartment 110. The vending compartment 320 may include conventional vending controls 330 such as selection panels and payment devices. A consumer may make a product selection at the vending compartment 320. The vending compartment 320 may deliver the ambient product 30 to the temperature controlled compartment 130 and/or the identification module 160. The corresponding temperature controlled product 40 then may be vended as above. The vending compartment 320 may be at ambient or any desired temperature. As is shown in FIG. 6, a merchandiser 340 also may be modular with the vending compartment 320 separate from the temperature controlled compartment 130. Other configurations may be used herein.

In an alternative embodiment, the merchandiser 310 may include an ambient glass front compartment that resembles a glass front cooler, but operates at ambient temperature. The glass front portion of the merchandiser 310 may sit integrally with or merely proximate to the temperature controlled compartment 130, and may be accessed in response to a payment operation that allows the door to be opened via a payment module in response to completing a valid transaction.

Figure 7:
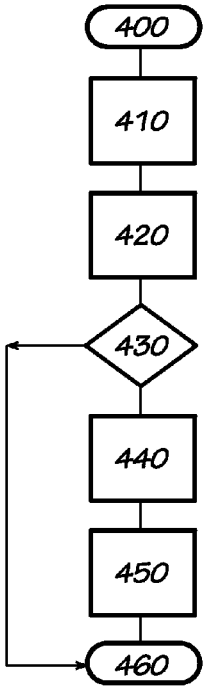
FIG. 7 is a flowchart showing a number of steps in the dispensing of a product in the merchandiser described herein.

FIG. 7 shows a flowchart of several of the process steps that may be used herein in providing the product 10 to a consumer. The process starts at step 400 in which the consumer approaches the merchandiser 100. At step 410, the consumer may remove one of the products 10 from one of the ambient compartment shelves 120 of the ambient compartment 110, i.e., the selected ambient product 30. At step 420, the consumer may place the selected ambient product 30 in the identification module 160. At step 430, the identification module 160 identifies the product 30 therein. If the product 30 is identified, the process continues to step 440. If not, the process is terminated. At step 440, the internal transport system 190 may dispense a temperature controlled product 40 to the vending port 180 that is temperature controlled and corresponds to the selected ambient product 30. At step 450, the internal transport system 190 may position the ambient product 30 in the temperature controlled compartment 130 so as to be temperature controlled and for later use as the temperature controlled product 40. The method ends at step 460. Other method steps may be used herein.

The merchandiser 100 may provide for at least a degree of product "purity", i.e., only a single brand, series of brands, or brands of a specific company may be recognized by the identification module 160 such that any other products 10 or brands may be rejected. This may be accomplished, for example, by the identification module 160 being adapted to recognize only predetermined products, rejecting all others by default. Further, a percentage of the products 10 therein may be of one brand or one company and a certain percentage may be of another. To enforce a permitted "purity" percentage, the identification module 160 further may include a counter-mechanism to keep inventory of different products 10 on hand in the temperature controlled compartment 130 and reject certain products 10 if their proportion in the temperature controlled compartment 130 exceeds a predetermined limit. Any percentage may be used herein. A balance of products 10 likewise may or may not be found in the ambient compartment 110 and the temperature controlled compartment 130.

The use of the merchandiser 100 thus provides the impulse purchases often found with an open front cooler given the use of the ambient compartment 110. The merchandiser 100, however, also provides the energy efficiency (and potentially even great efficiency) typically found with a glass door merchandiser given the use of the relatively smaller temperature controlled compartment 130 and the general lack of temperature controls about the ambient compartment 110.

Moreover, the positioning of the identification module 160 directly on top of the vending port 180 may give the consumer an enjoyable "instant chill" experience, i.e., simulating that the ambient product 30 was instantaneously cooled to its desired temperature as the temperature controlled product 140. The merchandiser 100 thus provides impulse purchases, energy efficiency, and an improved and enjoyable consumer experience.

Figure 8:
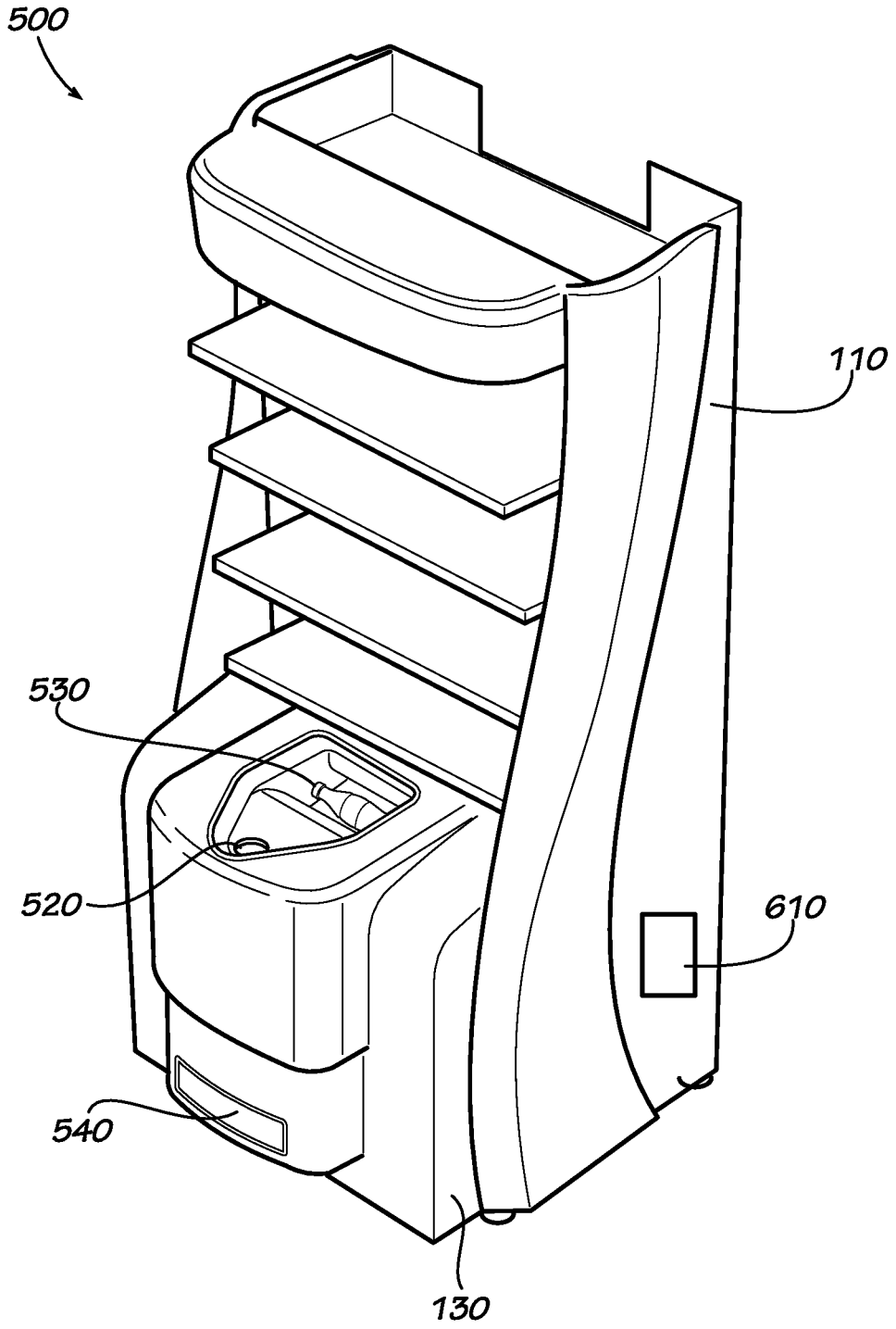
FIG. 8 is a perspective view of a further embodiment of a merchandiser as may be described herein.

FIG. 8 shows a further embodiment of a merchandiser 500 as may be described herein. Similar to the merchandisers described above, the merchandiser 500 may include a number of ambient products 30 positioned within the open or ambient compartment 110 and a number of temperature controlled products 40 in the temperature controlled compartment 130. The merchandiser 500 herein includes a rotary internal transport system 510. Generally described, the rotary internal transport system 510 includes an input port 520, a vending port 530, and a reject port 540 available to the consumer about an exterior thereof. Other components and other configurations may be used herein.

Figure 9:
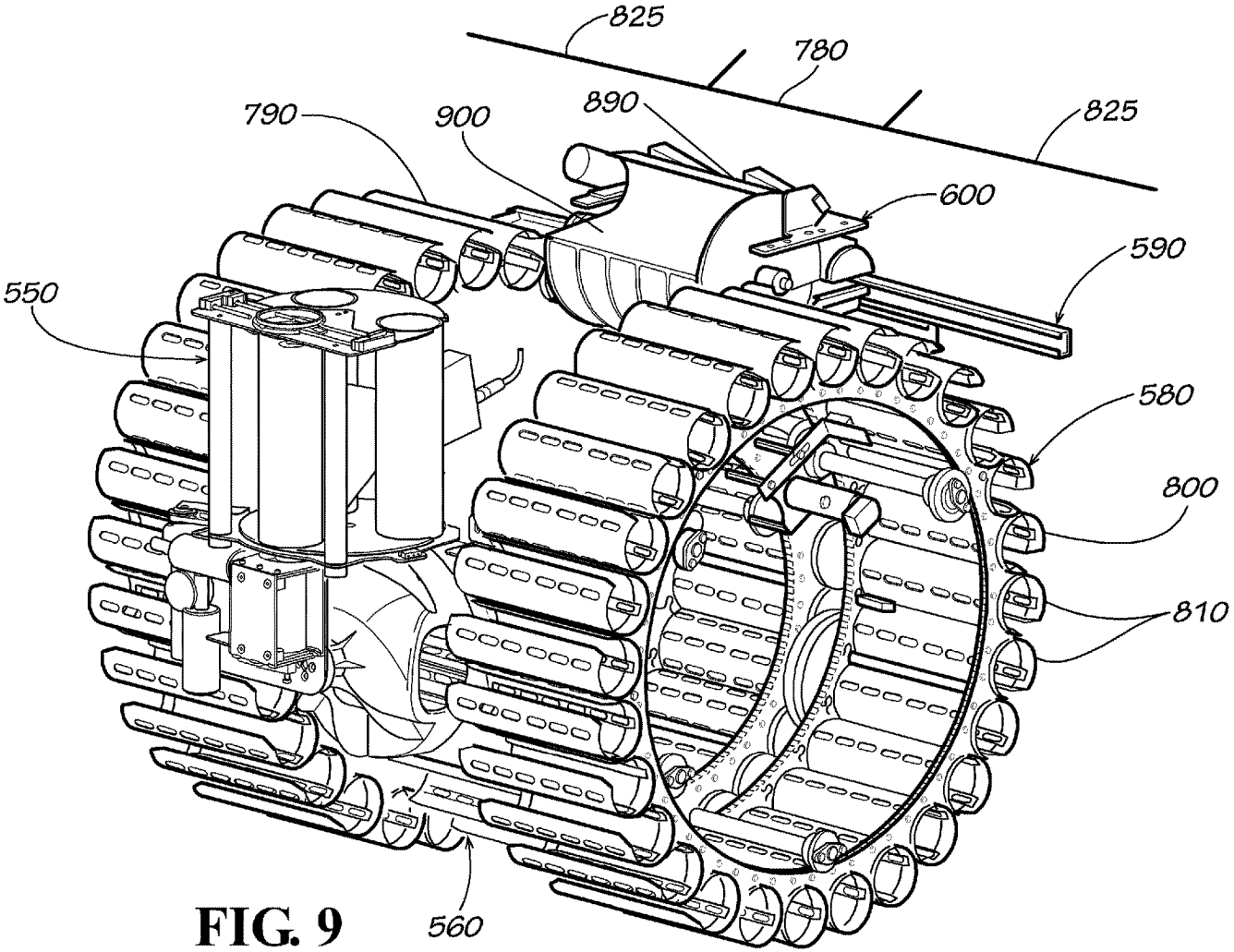
FIG. 9 is a perspective view of an alternative embodiment of a rotary internal transport system as may be used with the merchandiser of FIG. 8.
Figure 10:
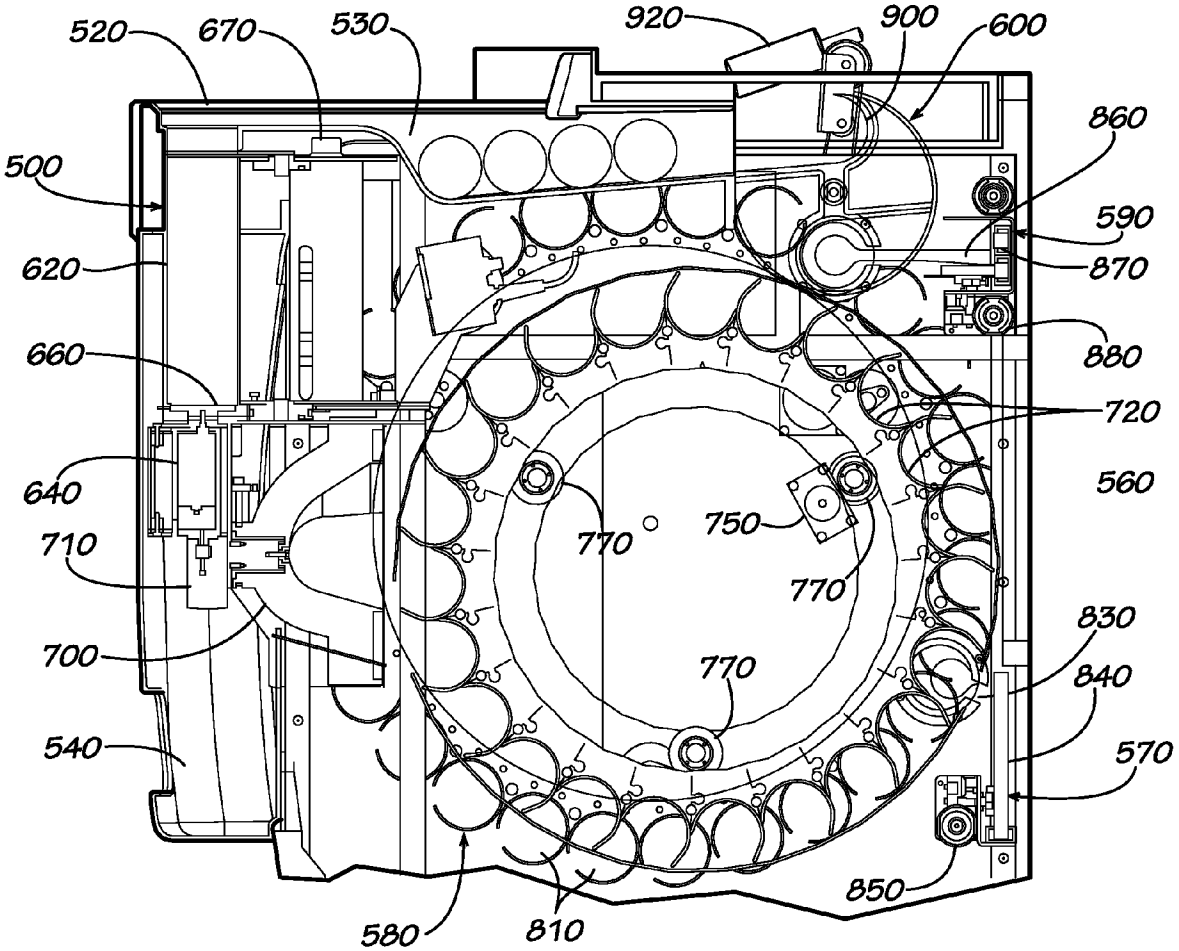
FIG. 10 is a partial side view of the rotary internal transport system of FIG. 9.

FIGS. 9 and 10 show an example of the rotary internal transport system 510. The rotary internal transport system 510 may be positioned within the temperature controlled compartment 130. Generally described, the rotary intake transport system 510 may include an input system 550, an input wheel 560, an input pusher system 570, one or more storage wheels 580, an output pusher system 590, a vending system 600, and a programmable controller 610. The programmable controller 610 may be of conventional design such that programming the various steps described below may be within the ability of one skilled in the art. As will be described in more detail below, all of these components need not necessarily be used together. Other components and other configurations may be used herein.

Figure 11:
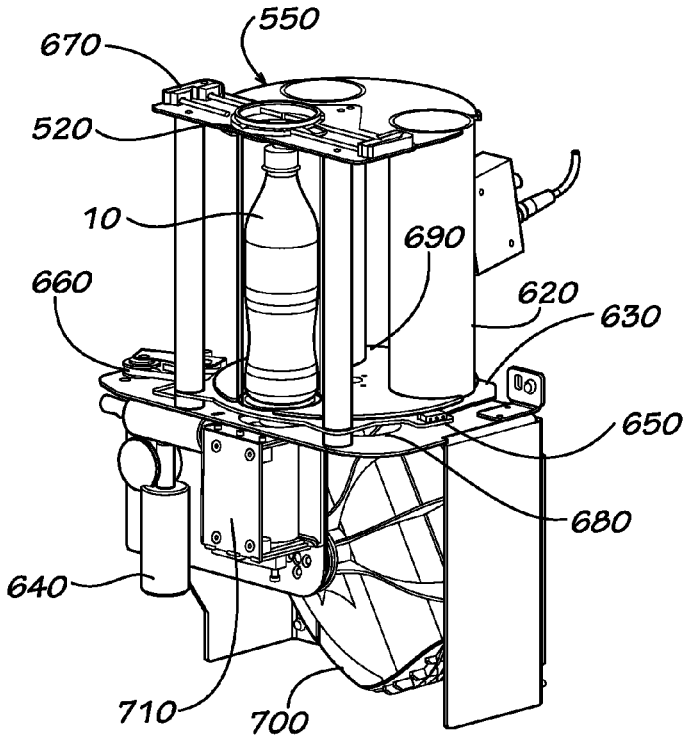
FIG. 11 is a perspective view of an input system of the rotary internal transport system of FIG. 9.
Figure 12:
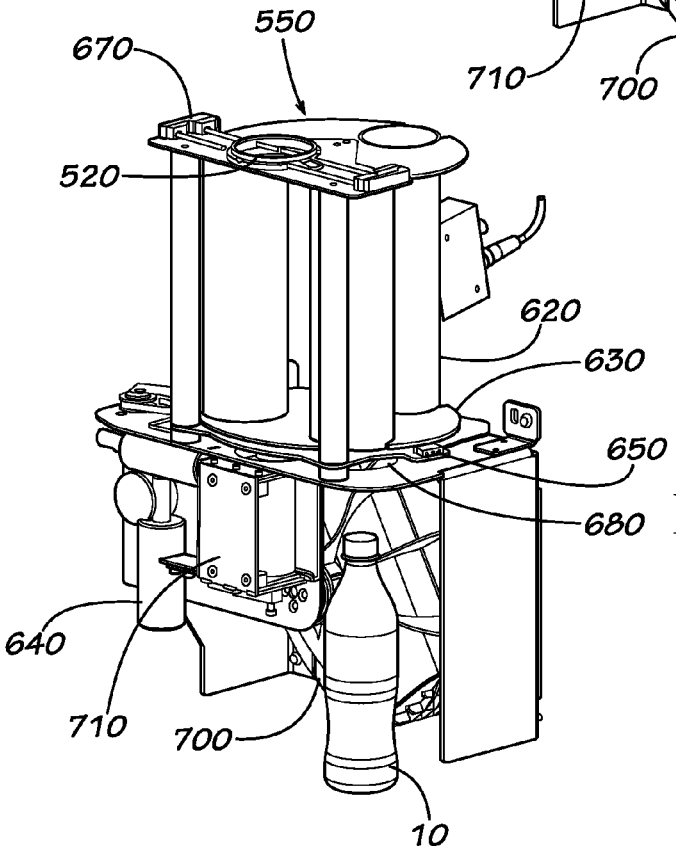
FIG. 12 is a further perspective view of the input system of FIG. 11.
Figure 13:
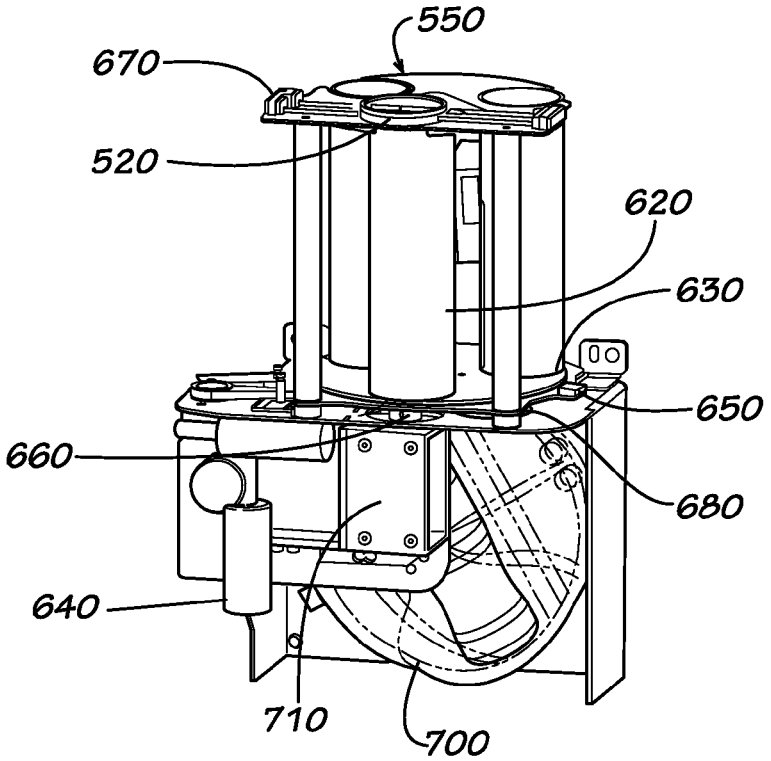
FIG. 13 is a further perspective view of the input system of FIG. 11.

Examples of the input system 550 are shown in FIGS. 11-13. The input system 550 may include a number of input tubes 620 positioned on a rotating plate 630. Any number of input tubes 620 may be used so as to accommodate a number of products 10 being placed into the merchandiser 500 in quick order. The input tubes 620 may be sized to accommodate a number of differing products 10 with differing dimensions and configurations. Each of the input tubes 620 may rotate with the rotating plate 630 into position about the input port 520 and elsewhere. The rotating plate 630 may be motor driven via a plate motor 640. In this example, the rotating plate 630 may be pulley driven although any type of drive means may be used herein. The plate motor 640 may be in communications with the controller 610. The position of the rotating plate 630 may be determined by a number of position sensors 650.

The input system 550 also may include a weight module 660 and an identification module 670. The weight module 660 may be positioned about the rotating plate 630 so as to weight the product 10 as it is positioned within one or the input tubes 620. The weight module 660 may be any type of electrical weight scale and the like. The weight module 660 may be in communication with the controller 610 so as to aid in identifying the product 10 therein. Likewise, the identification module 670 may be positioned about the input port 520 and the input tube 620. The identification module 670 may include a barcode scanner, an RFID tag reader, photoelectric cells, and/or any type of device that may read indicia on the product 10, identify the shape of the product 10, or otherwise identify the product. The combination of the weight module 660 and the identification module 670 may accurately identify the product 10 for the controller 610.

Based upon the identification of the product 10, the rotating plate 630 may rotate to a reject aperture 680 or to a swivel aperture 690. As is shown in FIG. 12, the reject aperture 680 permits the product 10 to fall towards the reject port 540 and out of the merchandiser 500 if an authorized product 10 is not identified. As is shown in FIG. 13, a properly identified product 10 may drop through the swivel aperture 690 into a swivel assembly 700.

The swivel assembly 700 may be substantially cup-like in shape. Similar shapes may be used herein. The swivel assembly 700 may be motor driven via a swivel motor 710. The swivel motor 710 also may be in communication with the controller 610. The swivel assembly 700 rotates so as to turn the incoming product 10 from a vertical position into a horizontal position for loading into the input wheel 560. Other components and other configurations may be used herein.

Figure 14:
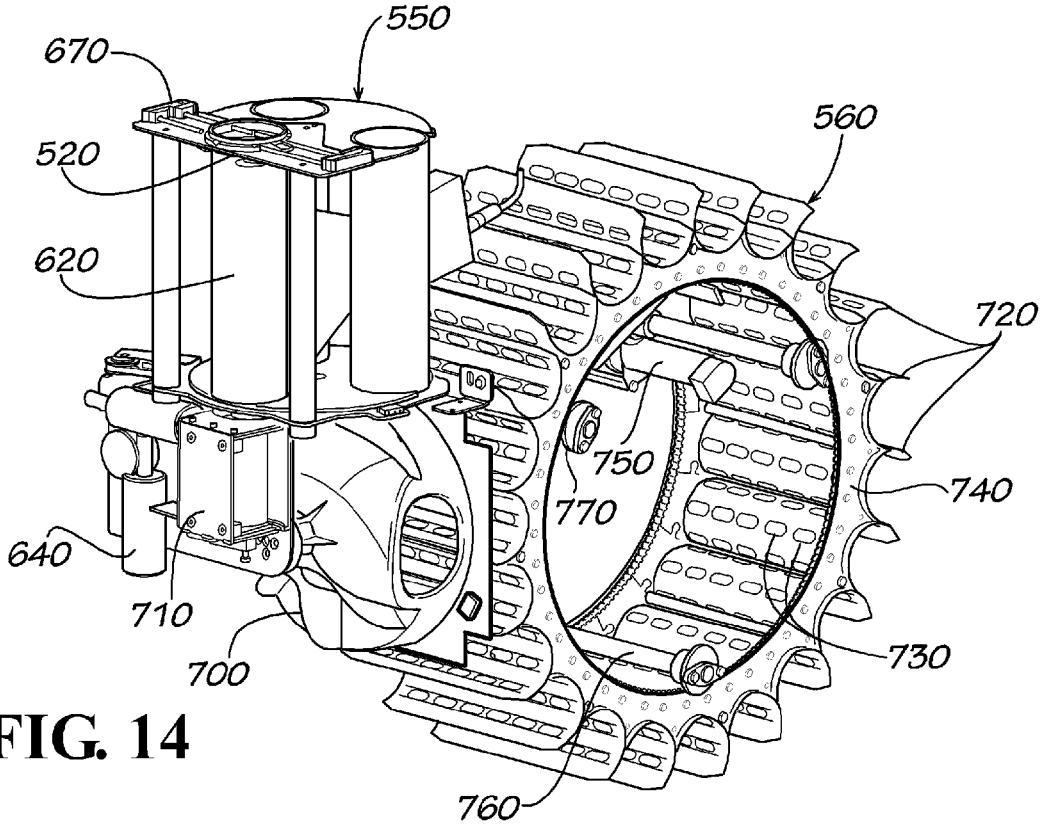
FIG. 14 is a partial perspective view of the input system and an input wheel of the rotary internal transport system of FIG. 9.

As is shown in FIG. 14, the input wheel 560 may include a number of incoming wheel support cups 720. Although twenty-three (23) incoming wheel support cups 720 are shown, any number may be used herein. The incoming wheel support cups 720 may be largely U-shaped or C-shaped so as to support a product 10 therein during rotation while allowing horizontal movement as will be described in more detail below. Each incoming wheel support cup 720 may have a number of cup apertures 730 therein. The cup apertures 730 allow for the drainage of condensation and the like. The support cups 720 may be positioned on a pair of support wheels 740 for rotation therewith. The support wheels 740 may be motor driven via an input wheel motor 750. The input wheel motor 750 may drive the support wheels 740 via a number of transmission rods 760 and gears 770. Other types of drive means may be used herein. The input wheel motor 750 may be in communication with the controller 610. Other components and other configurations may be used herein.

The input wheel 560 may be positioned within a quick chill section 780. The quick chill section 780 may be in communication with the heating/cooling module 150 as described above. The quick chill section 780 may be maintained at about −23 degrees Celsius or so as to chill quickly the products 10 therein in less than a minute or so. Other temperatures and other configurations may be used herein.

Figure 15:
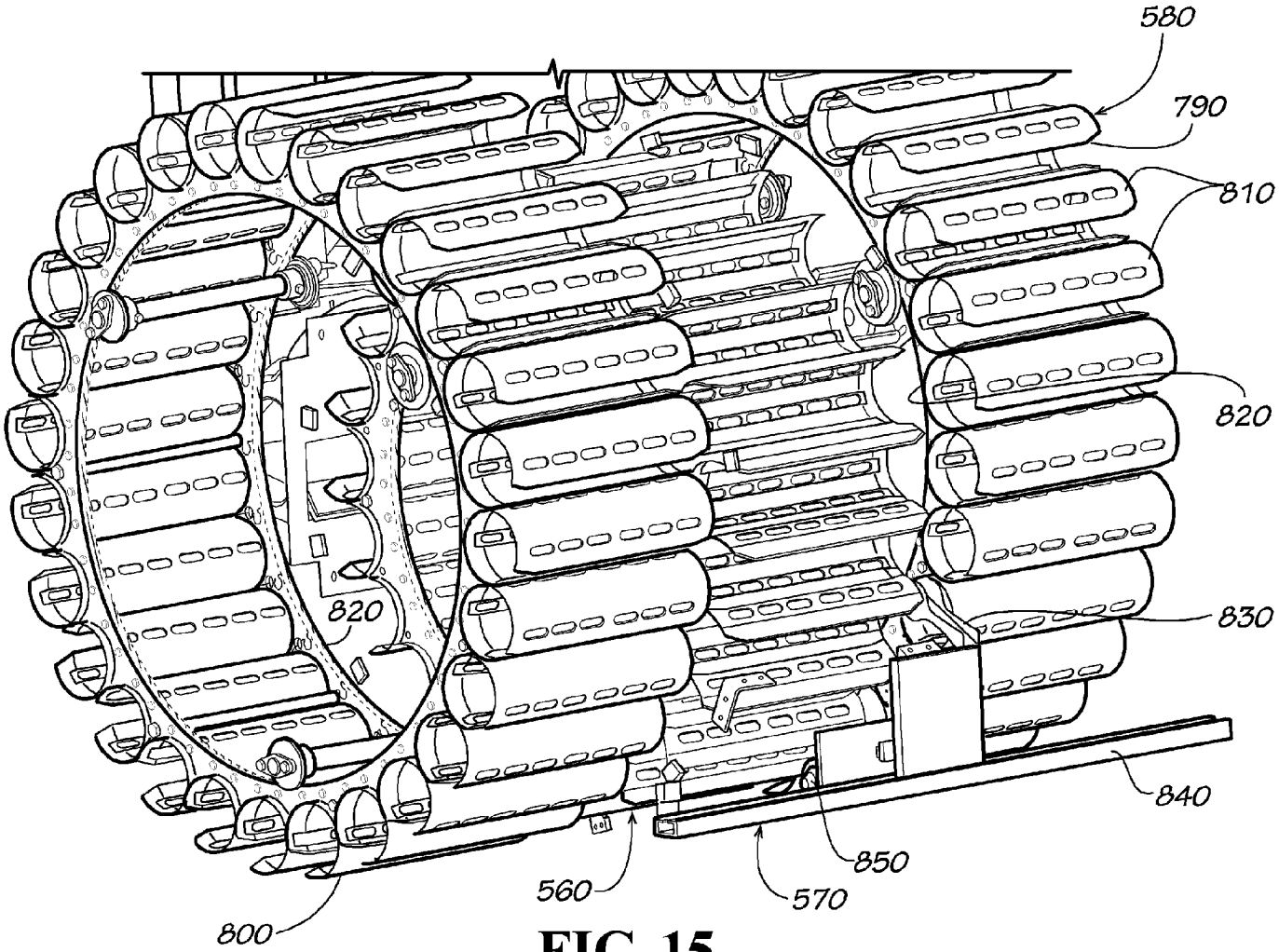
FIG. 15 is a partial perspective view of a number of storage wheels and an input pusher system positioned about the input wheel of the rotary internal transport system of FIG. 9.

FIG. 15 shows a first storage wheel 790 and a second storage wheel 800 of the one or more storage wheels 580 positioned about the input wheel 560. The storage wheels 790, 800 also include a number of storage wheel support cups 810. The storage wheel support cups 810 also may have a largely U-shape or a C-shape, but may be more tightly closed than the input wheel storage cups 720 given the complete rotation of the storage wheels 790, 800. The storage wheel support cups 810 also may be positioned on a number of storage support wheels 820 for rotation therewith. The storage support wheels 820 likewise may be driven by the input wheel motor via the drive rods 760 and the gears 770. A separate drive mechanisms in communication with the controller 610 also may be used herein. Other components and other configurations also may be used herein.

The one or more storage wheels 580 may be positioned within one or more constant cool sections 825. The constant cool sections 825 may be in communication with the heating/cooling module 150 as described above. The constant cool sections 825 may be maintained at about zero (0) degrees Celsius or higher so as to maintain the products 10 therein in a chilled condition without risk of freezing. Other temperatures and other configurations may be used herein.

FIG. 15 also shows the input pusher system 570. The input pusher system may be positioned between the input wheel 560 and the first storage wheel 790 or the second storage wheel 800. The input pusher system 570 includes one or more input arms 830. The input arms 830 may be maneuvered horizontally along a track 840 via an input pusher motor 850. The input pusher motor 850 may be in communication with the controller 610. The input pusher system 570 thus may push a product 10 from the input wheel 560 into the first or the second storage wheels 790, 800 via the input arms 830. Other components and other configurations may be used herein.

Figure 16:
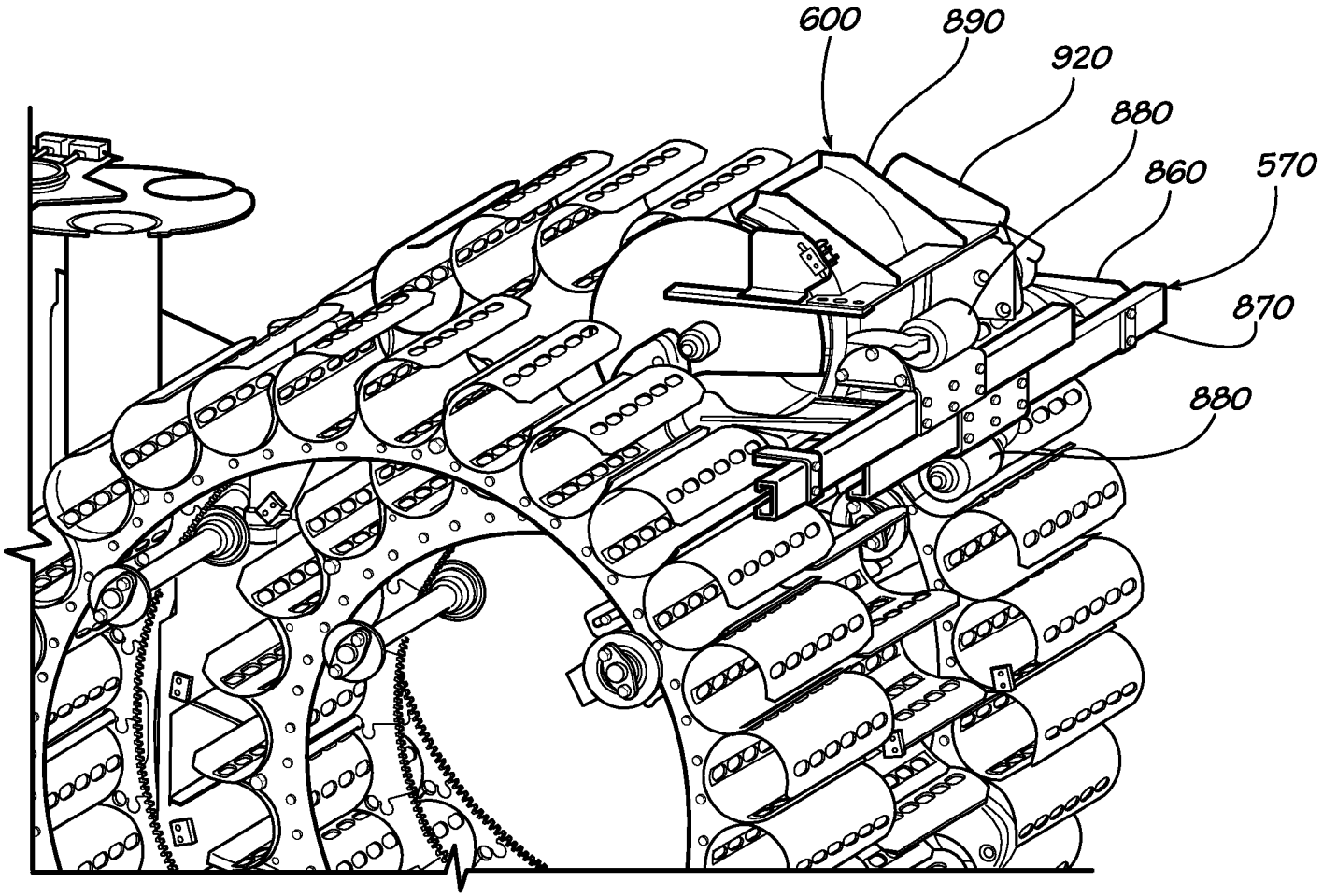
FIG. 16 is a partial perspective view of the storage wheels, an output pusher system, and a vending system of the rotary internal transport system of FIG. 9.

FIG. 16 shows the output pusher system 590 and the vending system 600. The output pusher system 590 also includes one or more output pusher arms 860 mounted on one or more output tracks 870. The output pusher arms 860 may be driven by one or more output pusher motors 880. The output pusher motor 880 may be in communication with the controller 610. The output pusher arm 860 pushes a product 10 from the first or the second storage wheel 790, 800 into the output system 600. Other components and other configurations may be used herein.

The vending system 600 may be positioned about the vending port 530. The vending system 600 may include a rotating dispensing wheel 890. The rotating dispensing wheel 890 may include a pair of opposed cups 900 positioned about a rod 910 for rotation therewith. The rotating dispensing wheel 890 may be motor driven by a dispensing motor 920. The dispensing motor 920 may be in communication with the controller 610. The product 10 may be pushed by the output pusher arm 860 of the output pusher system 600 into one of the opposed cups 900 of the rotating dispensing wheel 890. The rotating dispensing wheel 890 then may rotate via the dispensing motor 920 so as to dispense the product 10 therein into the vending port 530. Other components and other configurations may be used herein.

In use, a number of different products 10 may be positioned about the ambient shelves 120 and within the temperature controlled compartment 130. The temperature controlled compartment 130 may include the quick chill section 780 and the one or more constant cool sections 825. Alternatively, the temperature controlled compartment 130 may be at a uniform temperature throughout in the manner of the constant cool sections 825 and the like.

A consumer thus may place one of the products 10 into the input port 520 of the merchandiser 500. The product 10 falls into the input tube 620 and may be weighted via the weight module 660 and/or identified via the identification module 670. The controller 610 then determines if the product 10 is authorized for use herein. If not, the product 10 may be rejected via the reject port 540. If authorized, the product 10 may be positioned within the swivel assembly 700. The swivel assembly 700 turns the product 10 from a largely vertical orientation to a largely horizontal orientation. Other types of transitioning means may be used therein. The product 10 then may roll into one of the input wheel support cups 720 of the input wheel 560. If the quick chill section 780 is used, the product 10 may be chilled as the input wheel 560 rotates from the swivel assembly 700 to the input pusher system 570 or, alternatively, directly to the vending system 600. The controller 610 may determine the length of time the product 10 may be within the quick chill section 780 without freezing and the final destination of the product 10 within the input wheel 560.

The input arm 830 of the input pusher system 570 then may push the product 10 from the input wheel support cup 720 into the appropriate storage wheel support cup 810 of the first or second storage wheel 790, 800. Both, one, or neither of the storage wheels 790, 800 may be used herein. The controller 610 may track the position of the particular product 10 within the storage wheels 580. The controller 610 likewise may identify the appropriate product 10 and its position within the one or more storage wheels 580 in determining which product 10 to dispense. The controller 610 thus rotates the storage wheels 790, 800 to the output pusher system 590 and the vending system 600. The one or more output arms 860 of the output system 600 may push the appropriate product 10 into the rotating dispensing wheel 890 of the vending system 600. The product 10 thus rolls into the vending port 530 where it is accessible for removal by a consumer.

The merchandiser 500 thus provides many different products 10 to the consumer in a fast and efficient manner. Likewise, the use of the quick chill section 780 allows the merchandiser 500 to restock with chilled products 10 in a short amount of time. Any number of different products 10 may be positioned within the one or more storage wheels 580 so as to provide a wide variety to the consumer despite differing sizes and/or shapes.

Figure 17:
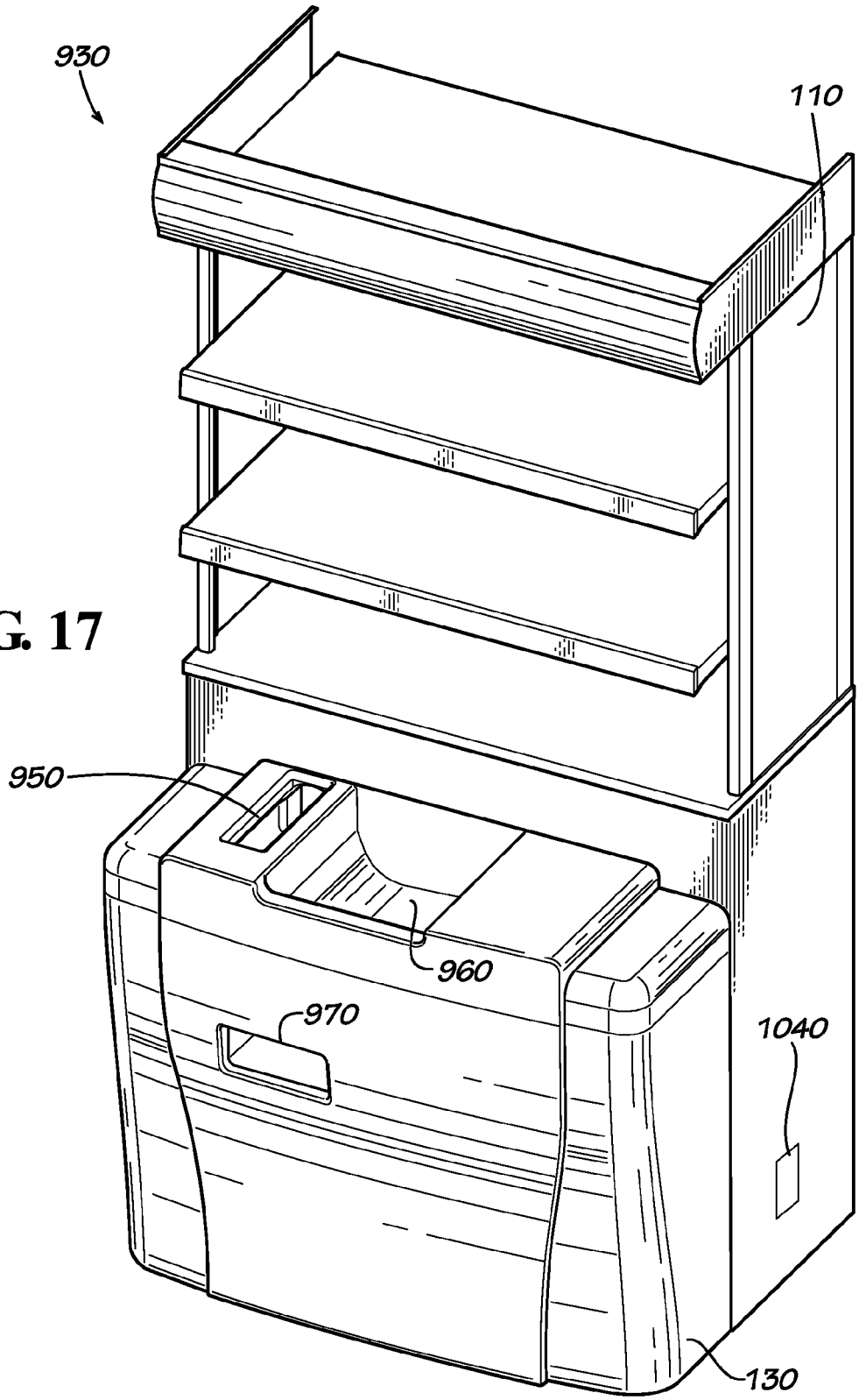
FIG. 17 is perspective view of a further embodiment of a merchandiser as may be described herein.
Figure 18:
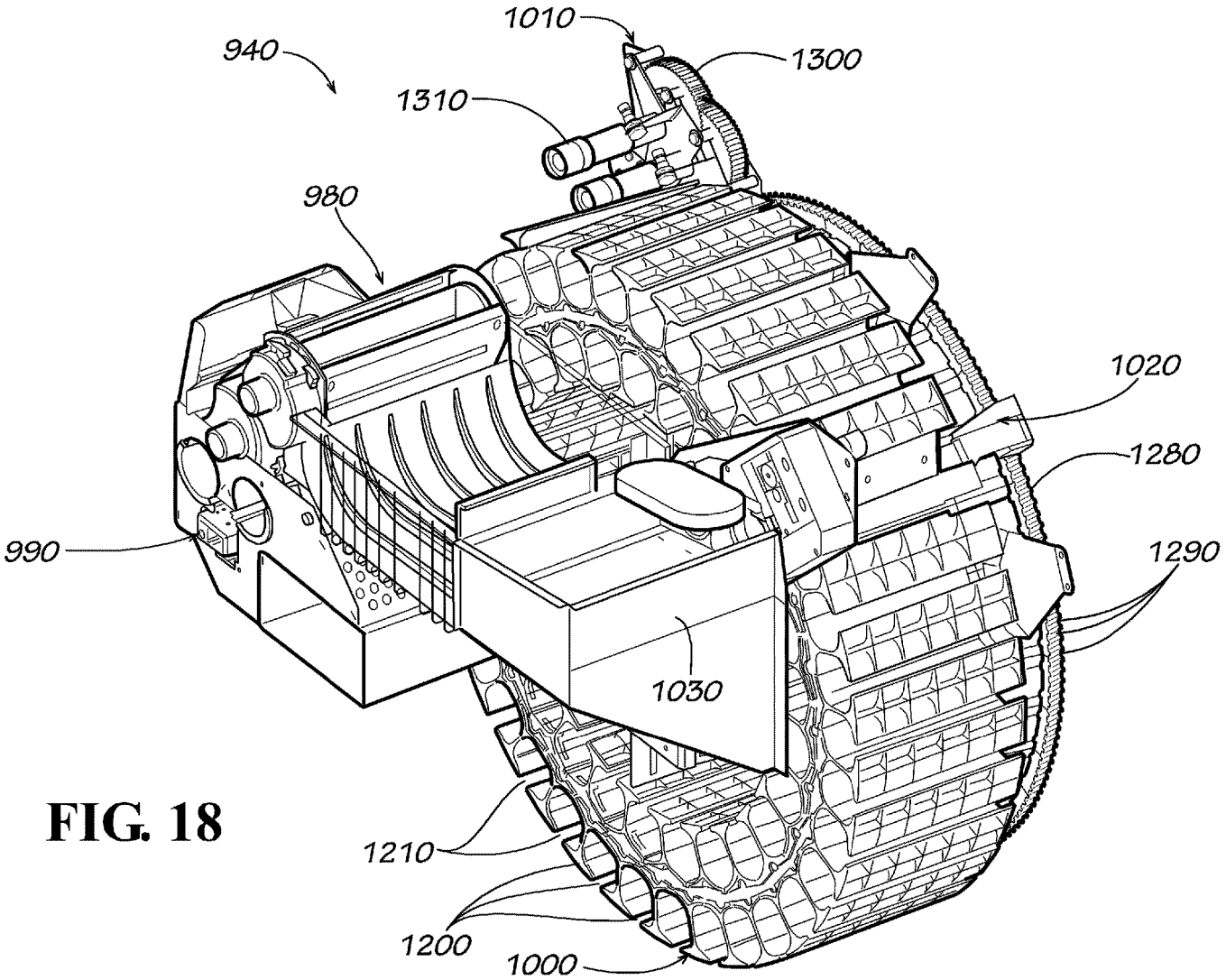
FIG. 18 is a perspective view of an alternative embodiment of a rotary internal transport system as may be used with the merchandiser of FIG. 17.
Figure 19:
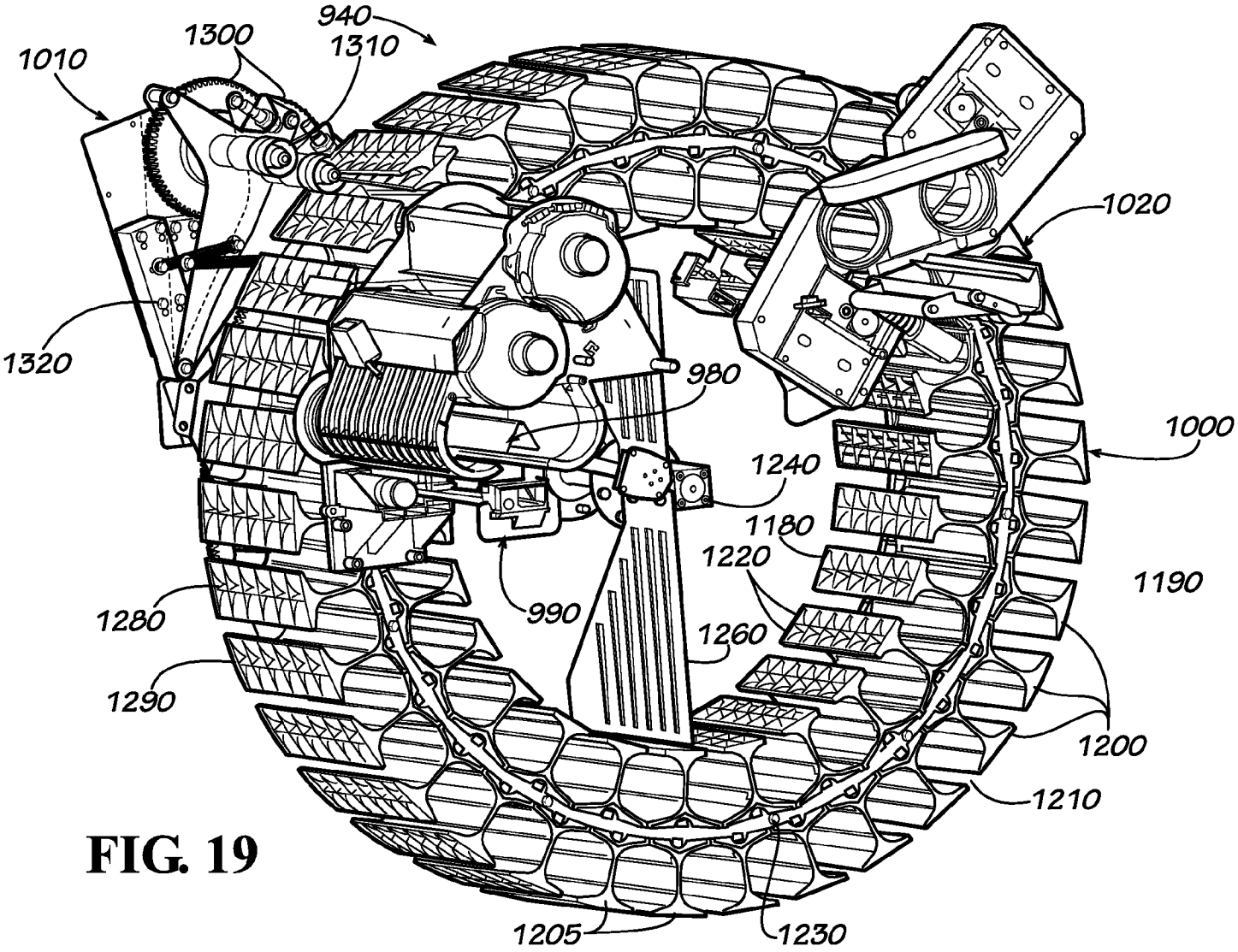
FIG. 19 is a further perspective view of the rotary internal transport system of FIG. 18 with specific components removed for clarity.
Figure 20:
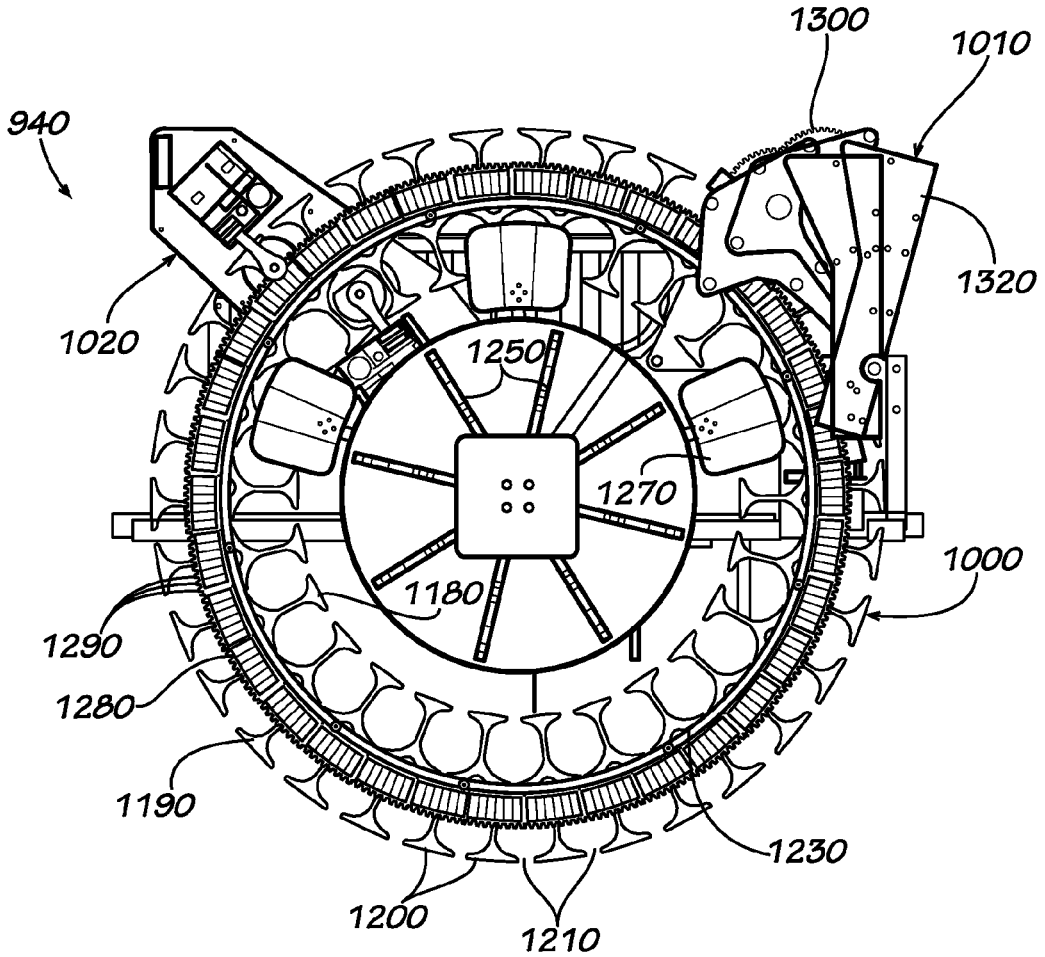
FIG. 20 is a rear plan view of the rotary internal transport system of FIG. 18.
Figure 21:
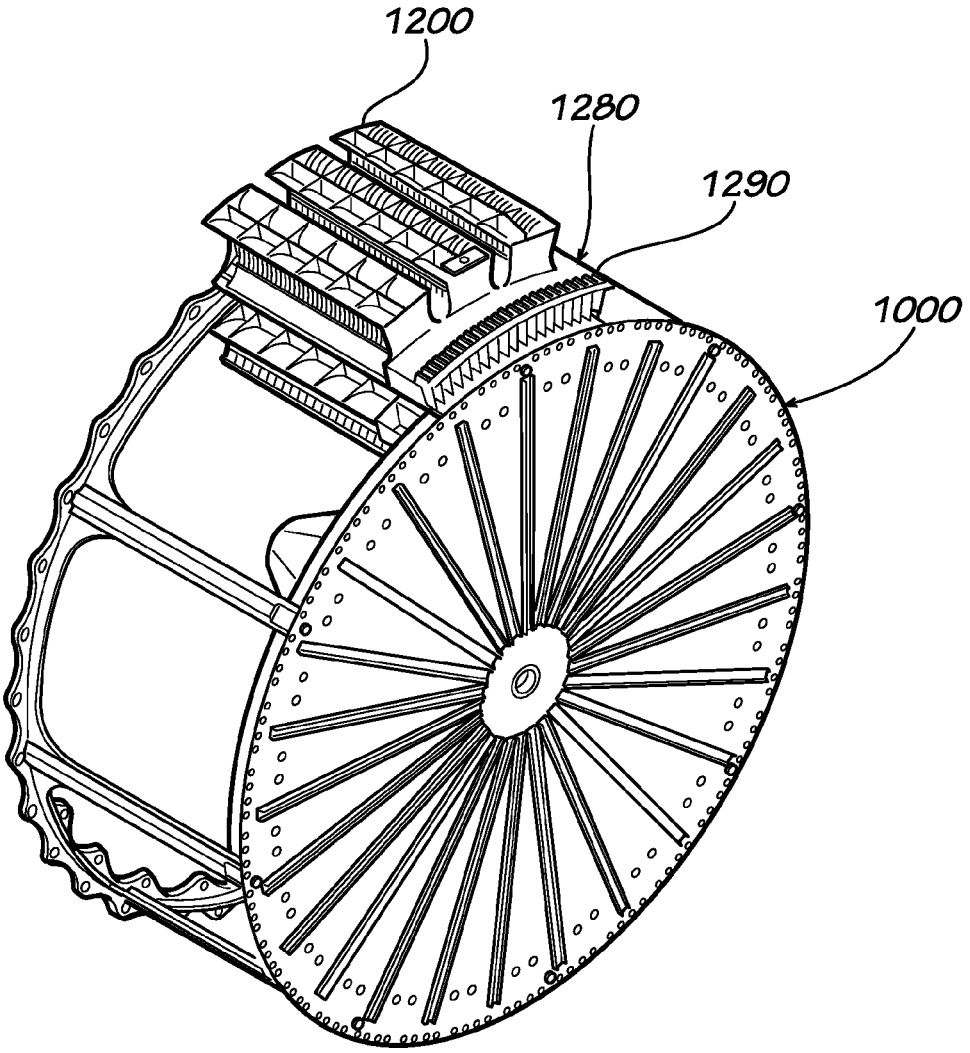
FIG. 21 is a partial rear perspective view of the rotary internal transport system of FIG. 18.

FIG. 17 shows a further embodiment of a merchandiser 930 as may be described herein. Similar to the merchandisers described above, the merchandiser 930 may include a number of ambient products 30 positioned within the open or ambient compartment 110 and a number of temperature controlled products 40 in the temperature controlled compartment 130. The merchandiser 930 also may include a rotary internal transport system 940. Generally described, the rotary internal transport system 940 may include an input port 950, a dispensing port 960, and a reject port 970 available to the consumer about an exterior thereof. Other components and other configurations may be used herein.

FIGS. 18-21 show an example of the rotary internal transport system 940 for use with the merchandiser 930 and elsewhere. The rotary internal transport system 940 may be positioned within the temperature controlled compartment 130. Generally described, the rotary intake transport system 940 may include an input system 980, an input pusher system 990, one or more storage wheels 1000, a storage wheel drive system 1010, an output pusher system 1020, a dispensing system 1030, and a programmable controller 1040. The programmable controller 1040 may be of conventional design such that programming the various steps described herein may be within the ability of one skilled in the art. As will be described in more detail below, not all of these components are required to be used herein. Other components and other configurations also may be used herein.

Figure 22:
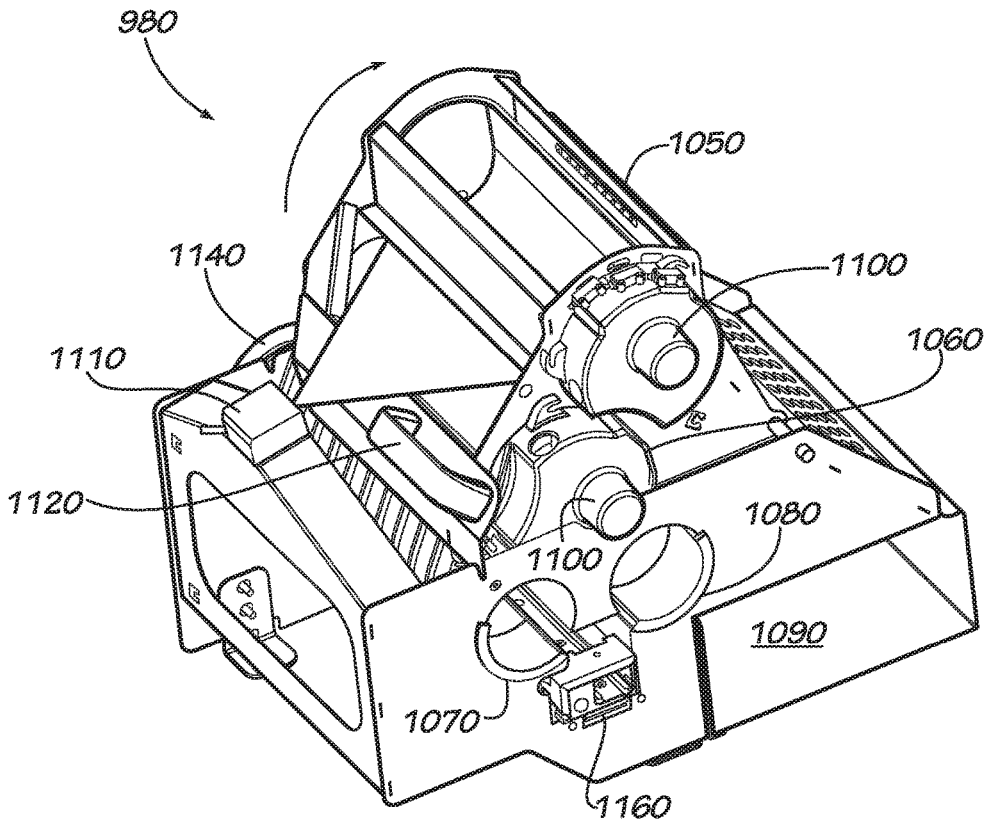
FIG. 22 is a perspective view of an input system as may be used with the rotary internal transport system of FIG. 18.

FIG. 22 shows an example of the input system 980 of the rotary internal transport system 940. The input system 980 may be positioned about the input port 950. The input system 980 may include an intake canister 1050, a delivery canister 1060, and a pair of slider gutters, a first slider gutter 1070 and a second slider gutter 1080, and a reject column 1090. Each of the canisters 1050, 1060 may be rotated by a canister motor 1100. The canister motors 1100 may be any device that provides rotational movement. The canister motors 1100 may be in communications with the controller 1040. The canisters 1050, 1060 may be sized to accommodate a number of different products 10 with differing dimensions and configurations. The input system 980 also may include an identification module 1110 positioned about the canisters 1060, 1070. The identification module 1110 may include a barcode scanner, an RFID tag reader, photoelectric cells, and/or any type of device that may read indicia on the product 10, identify the shape of the product 10, or otherwise identify the product 10. The canisters 1050, 1060 and the surrounding frame may be pivotable and may include a handle 1120 thereon. The handle 1120 allows the canisters 1050, 1060 to be opened so as to remove a misplaced product 10 in a manner similar to a conventional copier and the like. Other components and other configurations may be used herein.

Figure 23A:
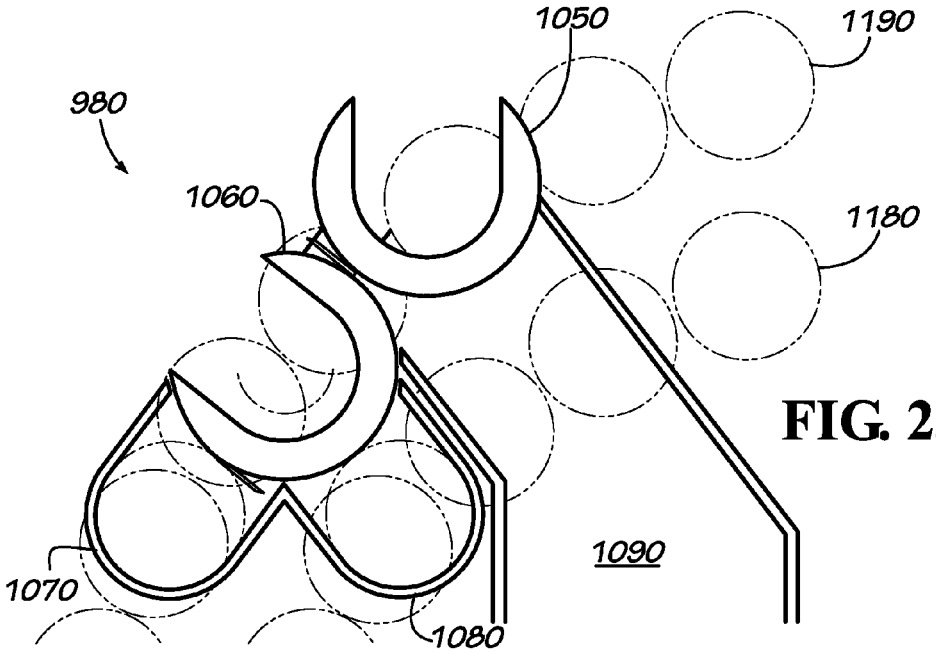
FIG. 23A is a schematic diagram of the input system in operation.
Figure 23B:
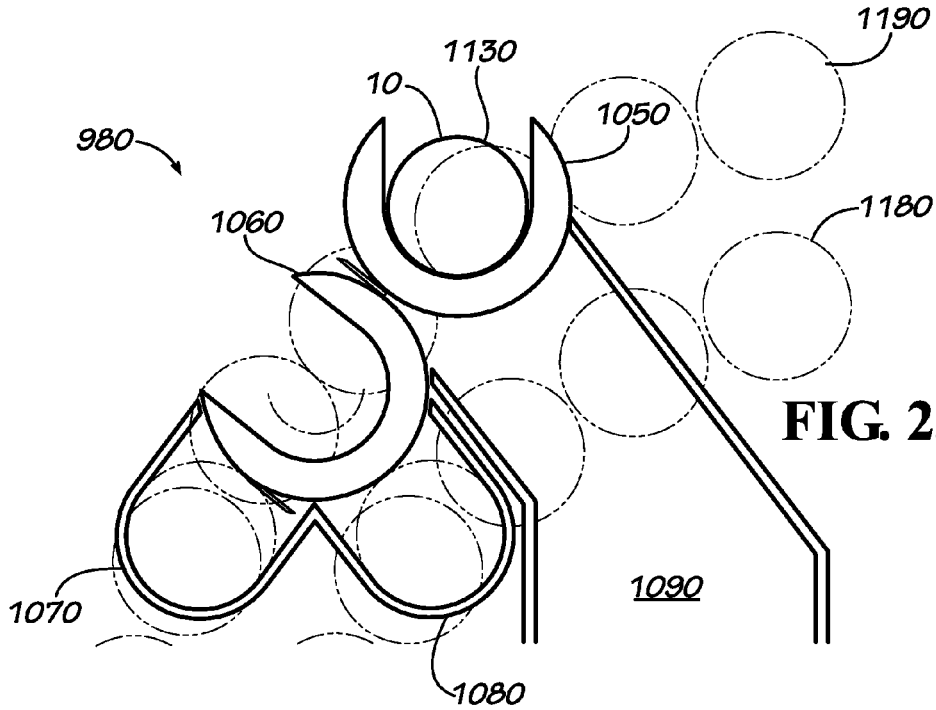
FIG. 23B is a schematic diagram of the input system in operation.
Figure 23C:
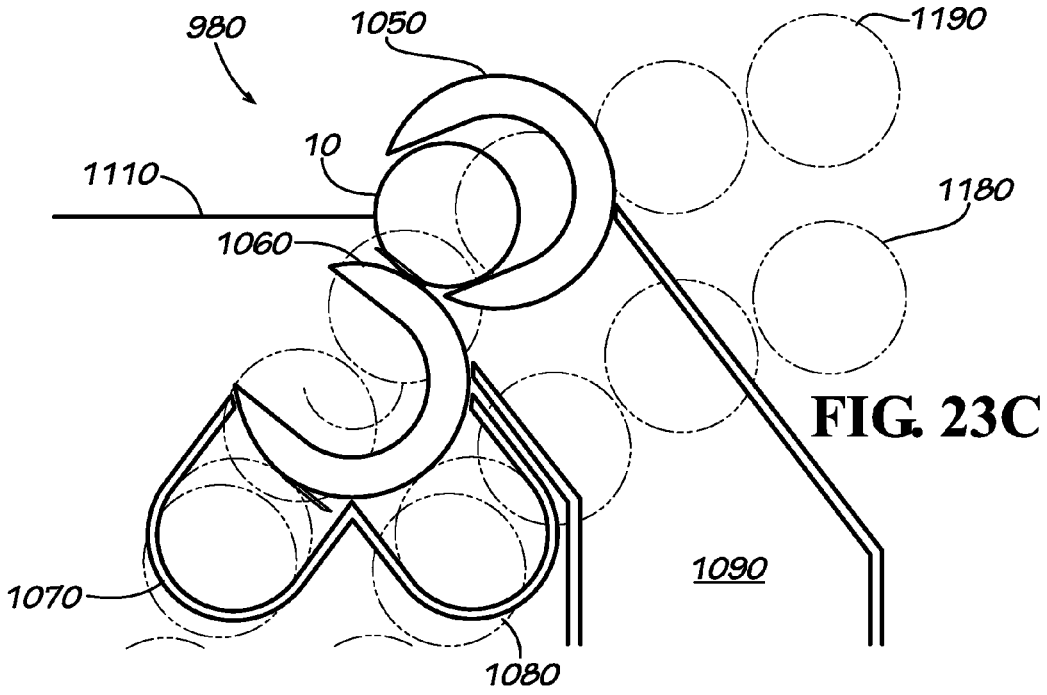
FIG. 23C is a schematic diagram of the input system in operation.
Figure 23D:
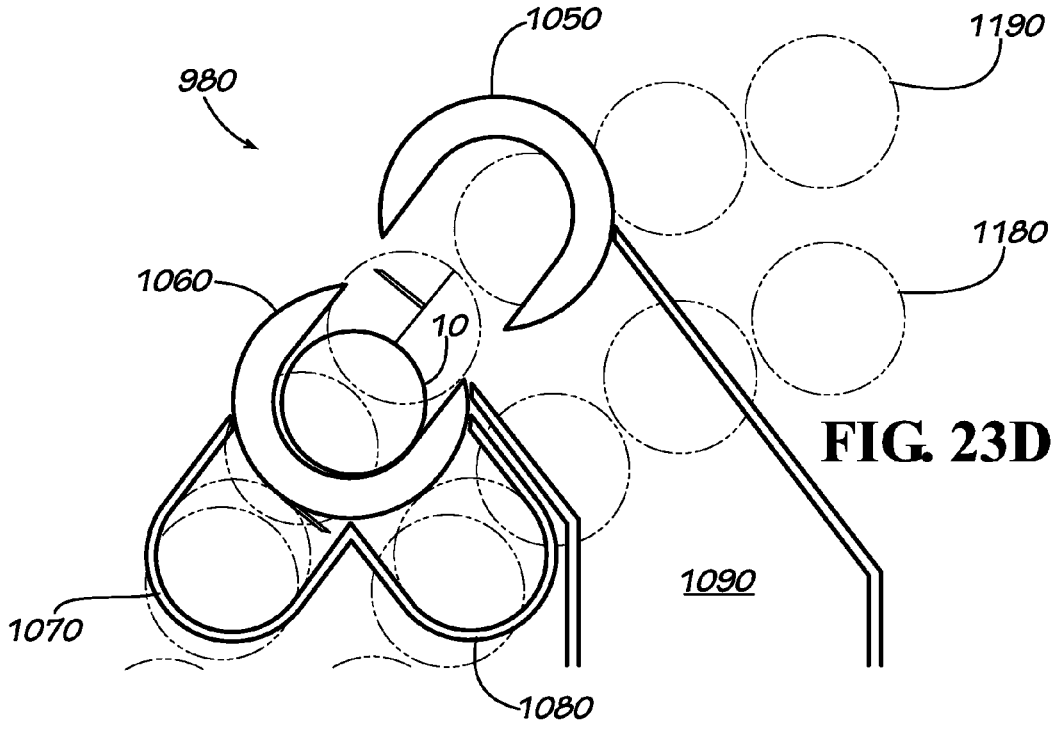
FIG. 23D is a schematic diagram of the input system in operation.
Figure 23E:
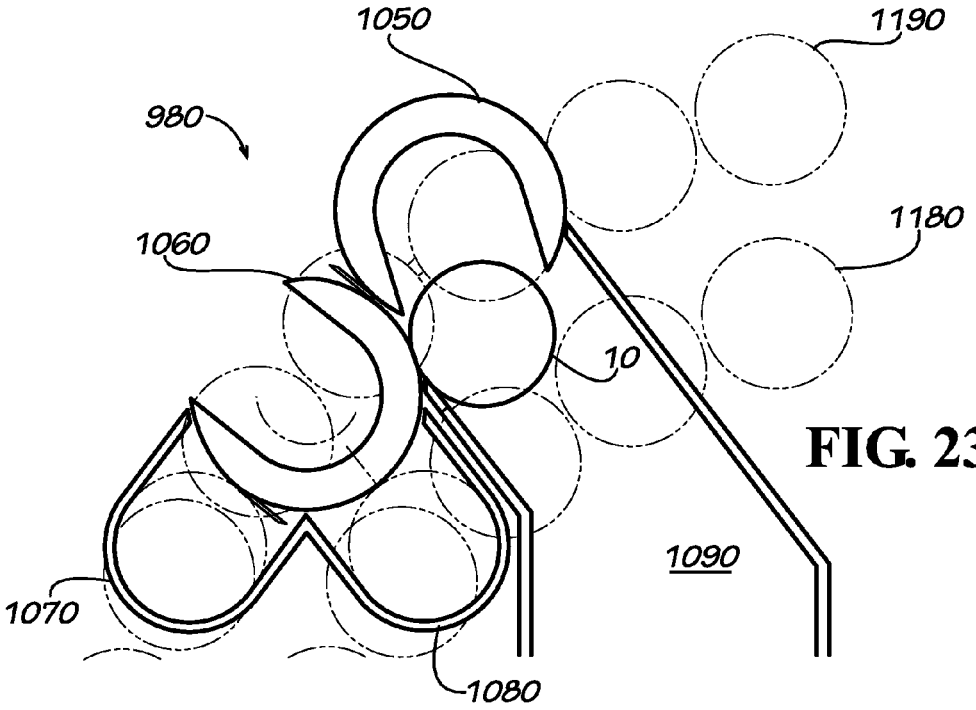
FIG. 23E is a schematic diagram of the input system in operation.
Figure 23F:
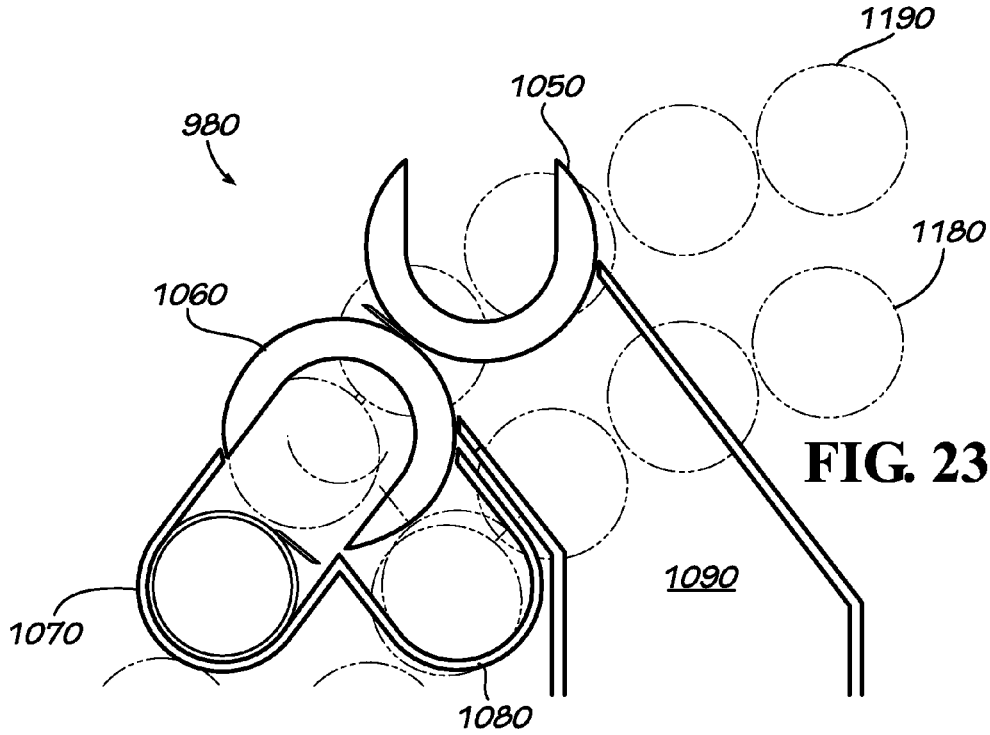
FIG. 23F is a schematic diagram of the input system in operation.
Figure 23G:
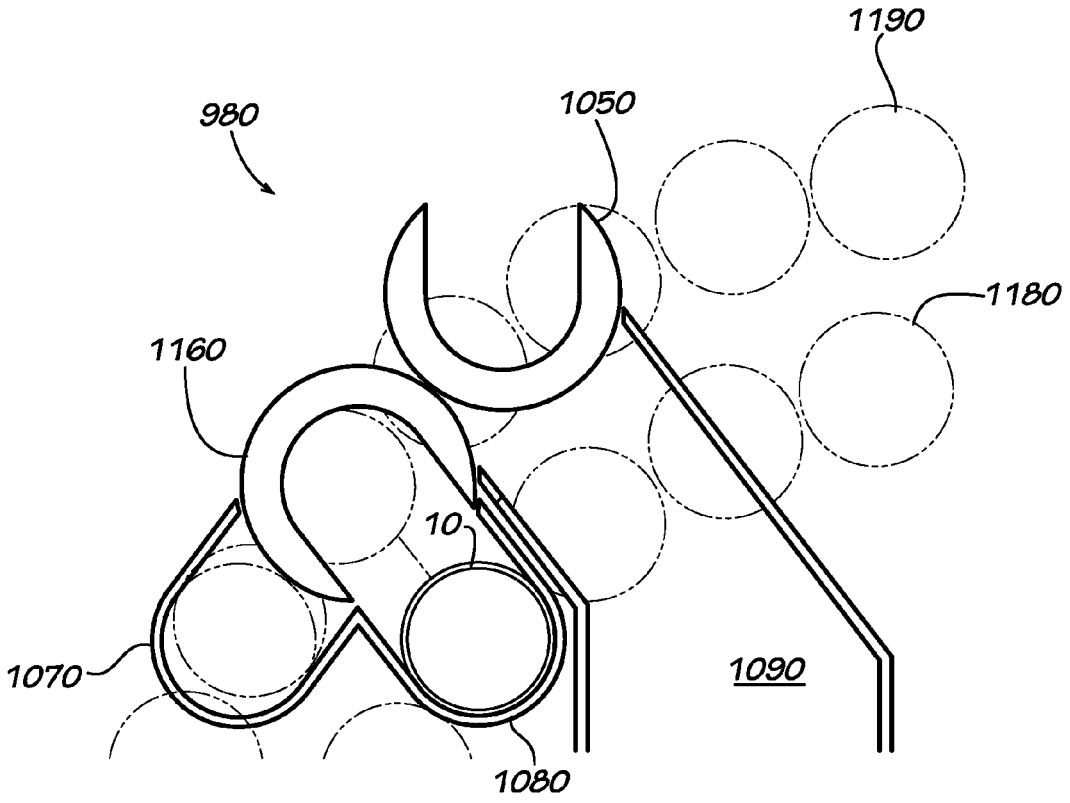
FIG. 23G is a schematic diagram of the input system in operation.

FIGS. 23A-23G show the operation of the input system 980. In FIG. 23A, the intake canister 1050 may be positioned underneath the input port 950 with the delivery canister 1060 blocking the slider gutters 1070, 1080. In FIG. 23B, a product 10 falls into the intake canister 1050 in a substantially horizontal position 1130. In FIG. 23C, the intake canister 1050 rotates downward such that the product 10 is visible to the identification module 1110. If the barcode or other indicia on the product 10 is not visible to the identification module 1110, the delivery canister 1060 may rotate the product 10 until the barcode is visible. If the product 10 is identified or otherwise accepted as a valid product, the canisters 1050, 1060 may rotate to face each other such that the product 10 drops into the delivery canister 1060 as is shown in FIG. 23D. If the product 10 is not identified or otherwise not accepted, the intake canister 1050 may rotate towards the reject column 1090 as is shown in FIG. 23E such that the product 10 will fall towards the reject port 970. In FIG. 23F, the delivery canister 1060 may rotate and drop the product 10 into the first slider gutter 1070. In FIG. 23G, the delivery canister 1060 may rotate and drop the product 10 into the second slider gutter 1080. The product 10 is now ready to be placed within the storage wheels 1000 as will be described in more detail below. Other and different method steps also may be used herein in any order in the intake process.

Figure 24:
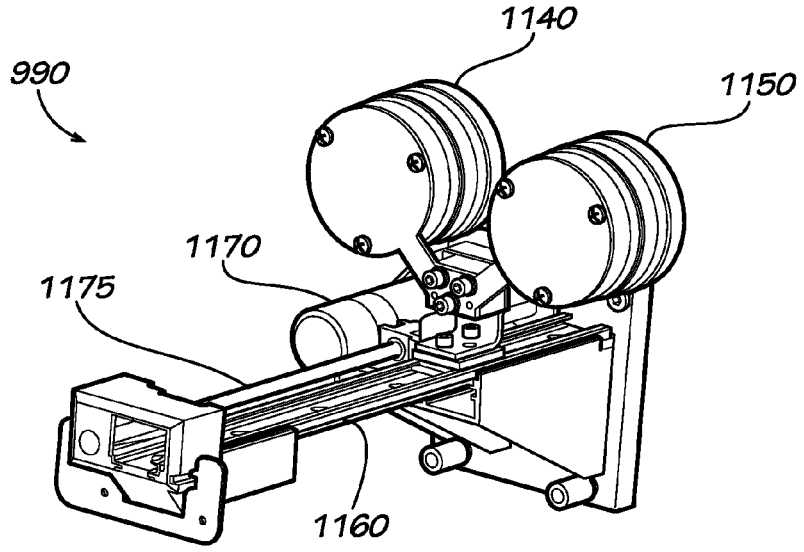
FIG. 24 is a perspective view of an input pusher system as may be used with the rotary internal transport system of FIG. 18.

FIG. 24 shows an example of the input pusher system 990 of the rotary internal transport system 940. The input pusher system 990 may include a pair of pusher pads, a first pusher pad 1140 and a second pusher pad 1150, positioned about an input rail 1160 for linear movement thereon. The first pusher pad 1140 may align with the first slider gutter 1070 and the second pusher pad 1150 may align with the second slider gutter 1080. The pusher pads 1150, 1160 may move along the input rail 1160 as driven by an input pusher motor 1170 via a drive rod 1175 or other type of drive device for linear motion. The input pusher motor 1170 may be in communication with the controller 1040. Alternatively, each of the pusher pads 1140, 1150 may have its own input rail 1160 and/or input pusher motor 1170. Any number of the pusher pads 1140, 1150 may be used herein. Once a product 10 falls into the first slider gutter 1070 or the second slider gutter 1080, the pusher pads 1140, 1150 of the input pusher system 990 may push the product 10 into one of the storage wheels 1000. The pusher pads 1140, 1150 also limit the loss of temperature controlled air. Other components and other configurations also may be used herein.

Referring again to FIGS. 18-21, an example of the storage wheels 1000 is shown. In this example, the storage wheels 1000 may include an inner storage wheel 1180 and an outer storage wheel 1190 positioned in a concentric arrangement. Any number of the storage wheels 1000 may be used herein. Although the storage wheels 1180, 1190 are shown as a unified element, independent storage wheels 1180, 1190 also may be used. The storage wheels 1000 may include a number of support cups 1200 positioned thereon. Any number of the support cups 1200 may be used herein. The support cups 1200 may be largely U-shaped or C-shaped so as to support a product 10 therein during rotation while allowing horizontal motion via the input pusher system 990 and the output pusher system 1020. More specifically, each cup 1200 may be formed out of two (2) substantially I-shaped halves 1205 that may be joined together to form the U or C-shape. As such, each of the support cups 1200 may include a pusher gap 1210 therein that may align with the pusher pads 1140, 1150. Each of the support cups 1200 also may have a number of cup apertures 1220 therein. The cup apertures 1220 allow for the drainage of condensation and the like.

The support cups 1200 may be positioned about a support ring 1230. The support cups 1200 may slide on and off the support ring 1230 for ease of cleaning and/or replacement. The support ring 1230 may rotate about a central hub 1240 via a number of spokes 1250. Other types of connection means may be used herein. An air deflector plate 1260 also may be attached to the central hub 1240. The air deflector plate 1260 ensures proper air circulation to all areas of the temperature controlled compartment 130. Any number of air deflector plates 1260 may be used herein. A number of input paddles 1270 also may be attached to the central hub 1240. The input paddles 1270 may align behind the support cups 1200 receiving the products 10 from the input pusher system 990 to ensure that the product 10 is not pushed beyond the end of the support cup 1200 so as to create an obstacle for rotation. Alternatively, a rear plate also may be used adjacent to the support cups 1200. Other components and other configurations also may be used herein.

The support cups 1200 also may form an outer drive wheel 1280. The outer drive wheel 1280 may be formed on one side thereof and may include a teethed surface 1290. The teethed surface 1290 may be driven by the storage wheel drive system 1100 for rotation therewith. The storage wheel drive system 1010 may include a number of gears 1300 that cooperate with the teethed surface 1290. The gears 1300 may be driven by a storage wheel drive motor 1310. The storage wheel drive motor 1310 may be any device that provides rotational movement. The storage wheel drive motor 1310 may be in communication with the programmable controller 1040. The gears 1300 may be positioned about a number of spring loaded levers 1320. The spring loaded levers 1320 may insure that the gears 1300 stay in contact with the teethed surface 1290 of the drive wheel 1280 for accurate rotation. Other components and other configurations may be used herein.

Figure 25:
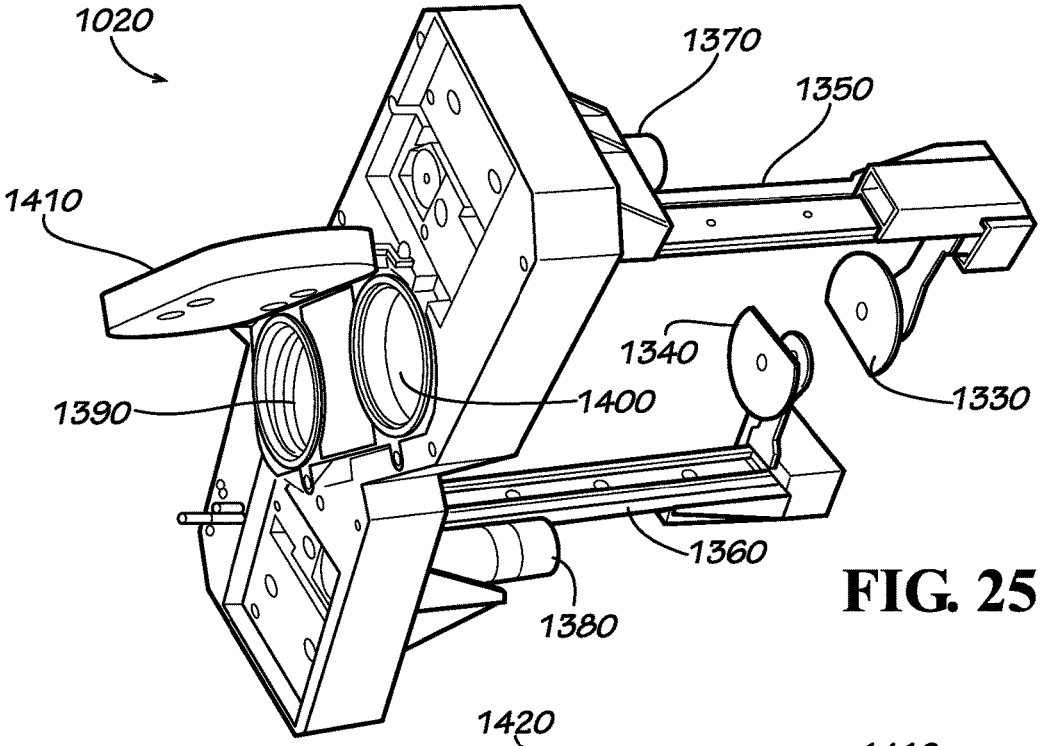
FIG. 25 is a perspective view of an output pusher system as may be used with the rotary internal transport system of FIG. 18.

FIG. 25 shows an example of the output pusher system 1020 of the rotary internal transport system 940. The output pusher system 1020 may include a pair of pusher pads, a first pusher pad 1330 and a second pusher pad 1340. Each of the pusher pads 1330, 1340 may be positioned on an output rail, a first rail 1350 and a second rail 1360. Each of the pusher pads 1330, 1340 may be operated by an output pusher motor, a first output pusher motor 1370 and a second output pusher motor 1380. The output pusher motors 1370, 1380 may be any type of drive device that provide linear movement. The output pusher motors 1370, 1380 may be in communication with the programmable controller 1040. Although the pusher pads 1330, 1340 are shown as having their own rail 1350, 1360, a joint configuration such as that described above also may be used herein. Any number of the pusher pads 1330, 1340, rails 1350, 1360, and motors 1370, 1380 may be used herein. The pusher pads 1330, 1340 align with the cups 1200 on the inner storage wheel 1190 and the outer storage wheel 1190, respectively. The output pusher system 1020 thus pushes the product 10 out of the storage wheel 1000 via a pair of vending apertures, a first vending aperture 1390 and a second vending aperture 1400. Other components and other configurations may be used herein.

Figure 26:
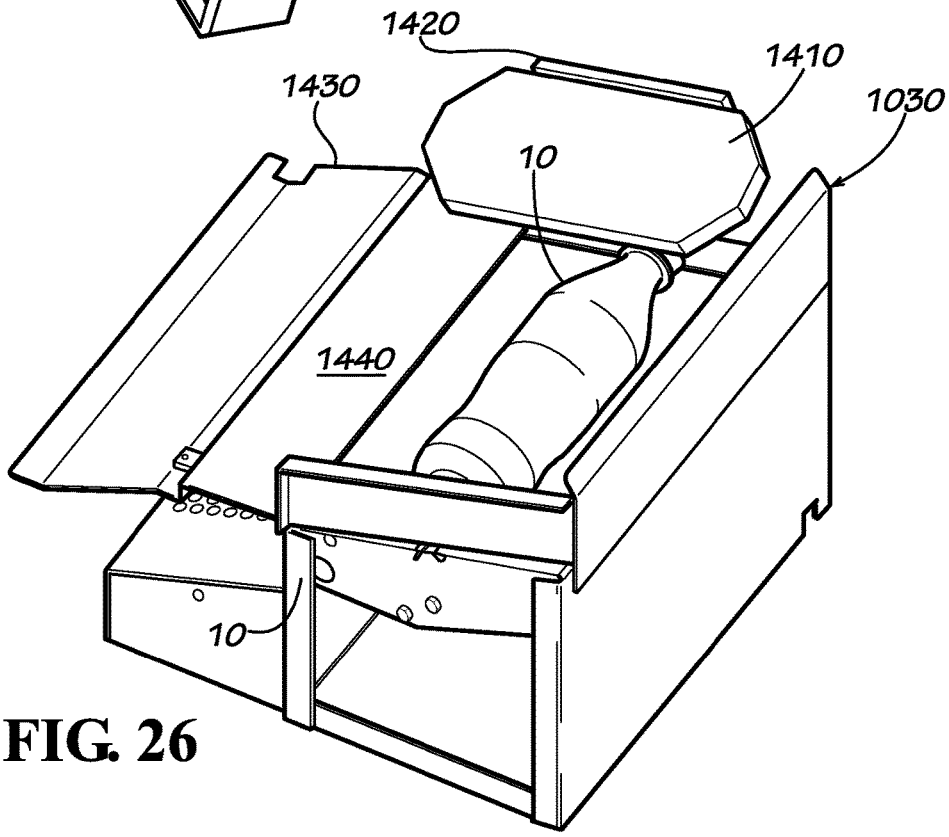
FIG. 26 is a perspective view of a vending system of the rotary internal transport system of FIG. 18.

FIG. 26 shows an example of the dispensing system 1030 of the rotary internal transport system 940. The dispensing system 1030 may be positioned adjacent to the vending apertures 1390, 1400. One or more vending aperture doors 1410 may enclose the vending apertures 1390, 1400. The vending aperture doors 1410 may be insulated so as to minimize the loss of cooling air therethrough. The vending aperture doors 1410 may be pivotable and may include a return spring 1420 to limit the amount of time that the doors 1410 remains open. The dispensing system 1030 also may include a vending door 1430. The vending door 1430 may be pivotable and create a ramp to the vending port 960. The vending door 1430 may be positioned about a slanted floor 1440. The slanted floor 1440 may be of any suitable angle. A product 10 thus may be pushed out of the vending apertures 1390, 1400 by the output pusher system 1020, roll down the slanted floor 1440, and roll through the vending door 1430 into the vending port 960. The product 10 thus rolls into the dispensing port 960 in the horizontal position 1130. The product 10 then may be removed from the merchandiser 930 by the consumer. Other components and other configurations may be used herein.

In use, a number of different products 10 may be positioned about the ambient shelves 12 and within the temperature controlled compartment 130. The temperature controlled compartment generally will remain completely stocked with a product 10 in each of the support cups 1200 of the storage wheels 1000 within the temperature controlled compartment 130. A customer thus may place one of the products 10 into the input port 950 of the merchandiser 930. The product 10 falls into the input system 980 and may be identified via the identification module 1110. The controller 1040 then determines if the product 10 is authorized for use therein. If not, the product 10 may be rejected via the reject port 970.

If authorized, the controller 1040 likewise may identify the appropriate product 10 and its position within the storage wheels 1000 in determining which product 10 to dispense. The controller 1040 thus rotates the storage wheels 1000 such that the appropriate support cup 1200 is adjacent to the output pusher system 1020. The output pusher system 1020 pushes the product 10 through the vending apertures 1390,

1400 and through the vending aperture door 1410. The product 10 thus rolls through the dispensing system 1030 and into the dispensing port 960. The controller 1040 may then rotate the now empty cup 1200 back towards the input pusher system 990. The input pusher system 990 may then push the original ambient product 10 into the empty cup 1200. In this manner, all of the support cups 1200 may remain full.

The controller 1040 may track the position of the products 10 in the storage wheels 1000 via a storage wheel content table. Each row of the table may represent a location in the storage wheels 1000. The table further may include the product name (or barcode number), date and time the product 10 was entered, and storage location status such as "empty", "stored", "input busy", or "output busy". The controller 1040 thus maintains this data. Each product type (SKU) may be queued separately. The products 10 may be dispensed in a "first in, first out" scheme such that the product 10 that has been in the temperature controlled compartment 130 the longest is dispensed first to ensure a cold (or hot) product 10. The controller 1040 may reject a product 10 if a corresponding temperature controlled product has not been stored for a predetermined length of time. Other types of operational parameters may be used herein.

The merchandiser 930 described herein also is highly energy efficient. The cabinet 945 may be insulated. The pusher pads 1140, 1150 may be sufficiently thick so as to ensure that the slider gutters 1070, 1080 are blocked when not in use. Likewise, the canisters 1050, 1060 cooperate so as to prevent ambient air from entering or cooling air from leaving. Further, the vending aperture door 1410 ensures a minimum loss of cooling air via the vending apertures 1390, 1400. Likewise, the air deflector plate 1260 further ensures the proper circulation of cooling air within the temperature controlled compartment 130.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A merchandiser for dispensing a number of products, comprising:

a storage wheel;

an input canister positioned about the storage wheel;

a delivery canister and a reject column positioned about the input canister; an identification module positioned about the input canister such that the input canister rotates towards the delivery canister or the reject column;

a pair of slider gutters positioned about the delivery canister such the delivery canister rotates towards a first slider gutter or a second slider gutter; and an input pusher system positioned about the delivery canister and the storage wheel, wherein the input pusher system comprises a first pusher pad positioned about the first slider gutter for linear movement therein and a second pusher pad positioned along the second slider gutter for linear movement therein.

2. The merchandiser of claim 1, wherein the storage wheel comprises a plurality of concentric storage wheels.

3. The merchandiser of claim 1, wherein the storage wheel comprises a plurality of storage cups and wherein the plurality of storage cups are configured to accommodate the input pusher system.

4. The merchandiser of claim 1, wherein the storage wheel comprises an air deflector plate therein.

5. The merchandiser of claim 1, further comprising an output pusher system positioned about the storage wheel.

6. The merchandiser of claim 5, wherein the output pusher system comprises a pusher pad for linear movement along an output rail.

7. The merchandiser of claim 5, further comprising a vending system positioned about the output pusher system.

* * * * *